US011309632B2

(12) United States Patent
Kim et al.

(10) Patent No.: US 11,309,632 B2
(45) Date of Patent: Apr. 19, 2022

(54) LOW-LOSS AND FLEXIBLE CURVED OR ORTHOGONAL TRANSMISSION LINE-INTEGRATED MULTI-PORT ANTENNA FOR MMWAVE BAND

(71) Applicant: SENSORVIEW CO., LTD., Gyeonggi-do (KR)

(72) Inventors: Byoung Nam Kim, Gyeonggi-do (KR); Hong Il Yoo, Seoul (KR)

(73) Assignee: SENSORVIEW CO., LTD., Gyeonggi-do (KR)

( * ) Notice: Subject to any disclaimer, the term of this patent is extended or adjusted under 35 U.S.C. 154(b) by 240 days.

(21) Appl. No.: 16/775,706

(22) Filed: Jan. 29, 2020

(65) Prior Publication Data

US 2020/0251825 A1 Aug. 6, 2020

(30) Foreign Application Priority Data

Feb. 1, 2019 (KR) ..... 10-2019-0014011

(51) Int. Cl.
*H01Q 9/04* (2006.01)
*D01D 5/00* (2006.01)
(Continued)

(52) U.S. Cl.
CPC ..... *H01Q 9/0435* (2013.01); *D01D 5/0007* (2013.01); *H01Q 1/243* (2013.01);
(Continued)

(58) Field of Classification Search
CPC ..... H01Q 21/065; H01Q 1/243; H01Q 23/00; H01Q 1/38; H01P 3/085; H01P 3/14;
(Continued)

(56) References Cited

U.S. PATENT DOCUMENTS

2005/0030230 A1 2/2005 Otaka et al.
2015/0084825 A1* 3/2015 Lee ..... H01Q 1/526 343/841
(Continued)

FOREIGN PATENT DOCUMENTS

CN 108376828 A 8/2018
EP 3657596 A1 5/2020
TW 201824638 A 7/2018

OTHER PUBLICATIONS

Extended European Search Report from corresponding European Patent Application No. 20154341.0, dated Jun. 9, 2020.
(Continued)

*Primary Examiner* — Ricardo I Magallanes
(74) *Attorney, Agent, or Firm* — Harness, Dickey & Pierce, P.L.C.

(57) ABSTRACT

Disclosed is a low-loss and flexible curved or orthogonal transmission line-integrated multi-port antenna for an mmWave band. The low-loss and flexible curved transmission line-integrated multi-port antenna includes a multi-port antenna portion which includes a plurality of single antennas and forms multi-ports and a transmission line portion which includes a plurality of transmission lines which correspond to the single antennas, respectively, are integrated with electricity feeding portions of the single antennas to which central conductors used as signal lines of the transmission lines correspond, and has a curved shape. Here, the single antennas each include a ground plate, a dielectric substrate, formed on the ground plate, a signal conversion portion formed on the dielectric substrate, and an electricity feeding portion formed on the dielectric substrate and connected to the signal conversion portion.

18 Claims, 38 Drawing Sheets

(51) Int. Cl.

| | |
|---|---|
| ***H01Q 1/24*** | (2006.01) |
| ***H01Q 1/48*** | (2006.01) |
| ***H01Q 9/06*** | (2006.01) |
| ***H01Q 9/40*** | (2006.01) |
| ***H01Q 13/10*** | (2006.01) |
| ***H01Q 23/00*** | (2006.01) |

(52) U.S. Cl.
CPC ..... *H01Q 1/48* (2013.01); *H01Q 9/065* (2013.01); *H01Q 9/40* (2013.01); *H01Q 13/106* (2013.01); *H01Q 23/00* (2013.01)

(58) Field of Classification Search
CPC . H01P 3/006; H01P 3/026; H01P 3/06; D01D 5/0007
See application file for complete search history.

(56) References Cited

U.S. PATENT DOCUMENTS

| | | | | |
|---|---|---|---|---|
| 2018/0192514 | A1 | 7/2018 | Seo | |
| 2020/0161749 | A1* | 5/2020 | Onaka | H01Q 1/48 |
| 2021/0320429 | A1* | 10/2021 | Takayama | H01Q 1/085 |

OTHER PUBLICATIONS

Office Action from corresponding Taiwanese Patent Application No. 10920991520, dated Oct. 19, 2020.

* cited by examiner

LOW-LOSS AND FLEXIBLE CURVED OR ORTHOGONAL TRANSMISSION LINE-INTEGRATED MULTI-PORT ANTENNA FOR MMWAVE BAND

CROSS-REFERENCE TO RELATED APPLICATION

This application claims priority to and the benefit of Korean Patent Application No. 10-2019-0014011, filed on Feb. 1, 2019, the disclosure of which is incorporated herein by reference in its entirety.

FIELD

The present invention relates to an antenna for mmWave band, and more particularly, to a low-loss and flexible curved or orthogonal transmission line-integrated multi-port antenna in which a low-loss nanosheet is used instead of an existing polyimide (PI) or liquid crystal polymer (LCP)-based material, which has a high loss, and a transmission line and an antenna are integrated with each other to be applicable to a mobile device.

BACKGROUND

A next-generation 5G mobile communication system performs communication through a high frequency band of several ten GHzs, and a smart phone needs an antenna for a high frequency band of several ten GHzs therein. Particularly, a mobile built-in antenna used in a mobile device such as a smart phone receives a lot of influence of an internal environment of the smart phone. Here, it is necessary to locate an antenna at a position of minimizing an influence of surroundings. Also, in order to transmit or treat a superhigh frequency at a low loss, a low-loss and high performance transmission line is necessary.

Generally, dielectrics used in an antenna and a transmission line, which have less loss in permittivity, may reduce a loss in power to be transmitted. Accordingly, to manufacture a transmission line and an antenna which have a low-loss and high performance for superhigh frequency signal transmission, it is necessary to use a material having a dielectric loss tangent and low relative permittivity as low as possible. Particularly, in order to efficiently transmit signals having frequencies within bands of 3.5 GHz and 28 GHz used in a 5G mobile communication network, the significance of a transmission line and an antenna which have a low loss even in an mmWave band of 28 GHzs more and more increases.

SUMMARY

The present invention is directed to providing a low-loss and flexible curved transmission line-integrated multi-port antenna for an mmWave band, in which a material having low relative permittivity and a low dielectric loss tangent value is used and a low loss and high performance transmission line and an antenna are integrated using a flexible material having a variety of flexibilities.

The present invention is directed to providing a low-loss and flexible orthogonal transmission line-integrated multi-port antenna for an mmWave band, in which a material having low relative permittivity and a low dielectric loss tangent value is used and a low loss and high performance transmission line and an antenna are integrated using a flexible material having a variety of flexibilities.

The present invention is also directed to providing a mobile communication terminal including the low-loss and flexible curved transmission-integrated multi-port antenna for an mmWave band.

The present invention is also directed to providing a mobile communication terminal including the low-loss and flexible orthogonal transmission-integrated multi-port antenna for an mmWave band.

According to an aspect of the present invention, there is provided a low-loss and flexible curved transmission line-integrated multi-port antenna for an mmWave band. The low-loss and flexible curved transmission line-integrated multi-port antenna includes a multi-port antenna portion which includes a plurality of single antennas and forms multi-ports and a transmission line portion which includes a plurality of transmission lines which correspond to the single antennas, respectively, are integrated with electricity feeding portions of the single antennas to which central conductors used as signal lines of the transmission lines correspond, and has a curved shape. Here, the single antennas each include a ground plate, a dielectric substrate formed of a dielectric having a certain thickness on the ground plate, a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal, and an electricity feeding portion formed on the dielectric substrate and connected to the signal conversion portion. Also, the transmission lines each include a central conductor having one end integrated with the electricity feeding portion of the antenna and configured to transfer the transmitted or received electrical signal, an external conductor having the same axis as that of the central conductor and configured to shield the central conductor in an axial direction of the central conductor, and a dielectric formed between the central conductor and the external conductor in the axial direction. Here, the dielectric is a low-loss nanosheet material formed in a nanosheet including a lot of air space by electrospinning a resin at a high voltage.

The multi-port antenna portion may include the plurality of single antennas, and a beam pattern (radiation pattern) of the plurality of single antennas may include circular polarization.

The single antennas and the transmission lines may be formed by reinforcing a bonding force between the conductor and a dielectric sheet using a low-loss bonding sheet or bonding solution or by depositing the conductor on a nanosheet.

The transmission lines may each include a nanosheet dielectric having a certain thickness, conductor surfaces formed on an upper surface and a lower surface of the nanosheet dielectric, and a stripline transmission line formed as a signal line in centers of the nanosheet dielectric and the conductor surfaces. Also, a plurality of via holes may be formed between the conductor surface formed above the nanosheet dielectric and the conductor surface formed below the nanosheet dielectric.

The single antennas may each have a structure of a patch antenna, a microstrip patch antenna, or a diagonal line type patch antenna in which the signal conversion portion is a patch. Also, the patch antenna or the microstrip antenna may be formed of a metal and further include a ground plate located on a bottom surface. The dielectric substrate may be formed as a dielectric having a certain thickness on the ground plate and have a transmission line-integrated type structure.

The single antenna may be a dipole antenna, a monopole antenna, or a slot antenna implemented using a variety of slots.

The single antenna may be a planar inverted F antenna (PIFA) which is a built-in antenna built in a mobile communication terminal.

According to another aspect of the present invention, there is provided a mobile communication terminal including the above-described low-loss and flexible curved transmission line-integrated multi-port antenna.

According to still another aspect of the present invention, there is provided a low-loss and flexible curved transmission line-integrated multi-port antenna for an mmWave band. The low-loss and flexible curved transmission line-integrated multi-port antenna includes a multi-port antenna portion which includes a plurality of single antennas each configured to form one port and has a curved shape and a transmission line portion which includes a plurality of transmission lines which correspond to the single antennas, respectively, are integrated with electricity feeding portions of the single antennas to which central conductors used as signal lines of the transmission lines correspond, and has a curved shape. Here, the single antennas each include a ground plate, a dielectric substrate formed of a dielectric having a certain thickness on the ground plate, a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal, and an electricity feeding portion formed on the dielectric substrate and connected to the signal conversion portion. Also, the transmission lines each include a central conductor having one end integrated with the electricity feeding portion of the antenna and configured to transfer the transmitted or received electrical signal, an external conductor having the same axis as that of the central conductor and configured to shield the central conductor in an axial direction of the central conductor, and a dielectric formed between the central conductor and the external conductor in the axial direction. Here, the dielectric is a low-loss nanosheet material formed in a nanosheet including a lot of air space by electrospinning a resin at a high voltage.

The multi-port antenna portion may include the plurality of single antennas, and a beam pattern (radiation pattern) of the plurality of single antennas may include circular polarization.

The single antennas and the transmission lines may be formed by reinforcing a bonding force between the conductor and a dielectric sheet using a low-loss bonding sheet or bonding solution or by depositing the conductor on a nanosheet.

The transmission lines may each include a nanosheet dielectric having a certain thickness, conductor surfaces formed on an upper surface and a lower surface of the nanosheet dielectric, and a stripline transmission line formed as a signal line in centers of the nanosheet dielectric and the conductor surfaces. Also, a plurality of via holes may be formed between the conductor surface formed above the nanosheet dielectric and the conductor surface formed below the nanosheet dielectric.

The single antennas may each have a structure of a patch antenna, a microstrip patch antenna, or a diagonal line type patch antenna in which the signal conversion portion is a patch. Also, the patch antenna or the microstrip antenna may be formed of a metal and further include a ground plate located on a bottom surface. The dielectric substrate may be formed as a dielectric having a certain thickness on the ground plate and have a transmission line-integrated type structure.

The single antenna may be a dipole antenna, a monopole antenna, or a slot antenna implemented using a variety of slots.

The single antenna may be a PIFA which is a built-in antenna built in a mobile communication terminal.

According to yet another aspect of the present invention, there is provided a mobile communication terminal including the above-described low-loss and flexible curved transmission line-integrated multi-port antenna.

According to a further aspect of the present invention, there is provided a low-loss and flexible orthogonal transmission line-integrated multi-port antenna for an mmWave band. The low-loss and flexible orthogonal transmission line-integrated multi-port antenna includes a first multi-port antenna and a second multi-port antenna perpendicular to the first multi-port antenna. Here, the first multi-port antenna includes a first multi-port antenna portion which includes a plurality of single antennas horizontally arranged to form multi-ports and a first transmission line portion which includes a plurality of transmission lines which correspond to the single antennas, respectively, are integrated with electricity feeding portions of the single antennas to which central conductors used as signal lines of the transmission lines correspond. Also, the second multi-port antenna includes a second multi-port antenna portion which includes a plurality of single antennas arranged perpendicularly to the first multi-port antenna portion to form multi-ports and a second transmission line portion which includes a plurality of transmission lines which correspond to the single antennas of the second multi-port antenna portion, respectively, are integrated with electricity feeding portions of the single antennas of the second multi-port antenna portion to which central conductors used as signal lines of the transmission lines correspond. Here, the single antennas of the first multi-port antenna portion and the second multi-port antenna portion each include a ground plate, a dielectric substrate formed of a dielectric having a certain thickness on the ground plate, a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal, and an electricity feeding portion formed on the dielectric substrate and connected to the signal conversion portion. Also, the transmission lines each include a central conductor having one end integrated with the electricity feeding portion of the antenna and configured to transfer the transmitted or received electrical signal, an external conductor having the same axis as that of the central conductor and configured to shield the central conductor in an axial direction of the central conductor, and a dielectric formed between the central conductor and the external conductor in the axial direction. Also, the dielectric is a low-loss nanosheet material formed in a nanosheet including a lot of air space by electrospinning a resin at a high voltage.

The first multi-port antenna may include the plurality of single antennas horizontally arranged such that a beam pattern (radiation pattern) may include vertical polarization or horizontal polarization. Also, the second multi-port antenna may include the plurality of single antennas vertically arranged such that a beam pattern (radiation pattern) may include vertical polarization or horizontal polarization.

The single antennas and the transmission lines may be formed by reinforcing a bonding force between the conductor and a dielectric sheet using a low-loss bonding sheet or bonding solution or by depositing the conductor on a nanosheet.

The transmission lines may each include a nanosheet dielectric having a certain thickness, conductor surfaces formed on an upper surface and a lower surface of the nanosheet dielectric, and a stripline transmission line formed as a signal line in centers of the nanosheet dielectric and the conductor surfaces. Also, a plurality of via holes may be formed between the conductor surface formed above the nanosheet dielectric and the conductor surface formed below the nanosheet dielectric.

The single antennas may each have a structure of a patch antenna, a microstrip patch antenna, or a diagonal line type patch antenna in which the signal conversion portion is a patch. Also, the patch antenna or the microstrip antenna may be formed of a metal and further include a ground plate located on a bottom surface. The dielectric substrate may be formed as a dielectric having a certain thickness on the ground plate and have a transmission line-integrated type structure.

The single antenna may be a dipole antenna, a monopole antenna, or a slot antenna implemented using a variety of slots.

The single antenna may be a PIFA which is a built-in antenna built in a mobile communication terminal.

According to a still further aspect of the present invention, there is provided a mobile communication terminal including the above-described low-loss and flexible orthogonal transmission line-integrated multi-port antenna.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1A:
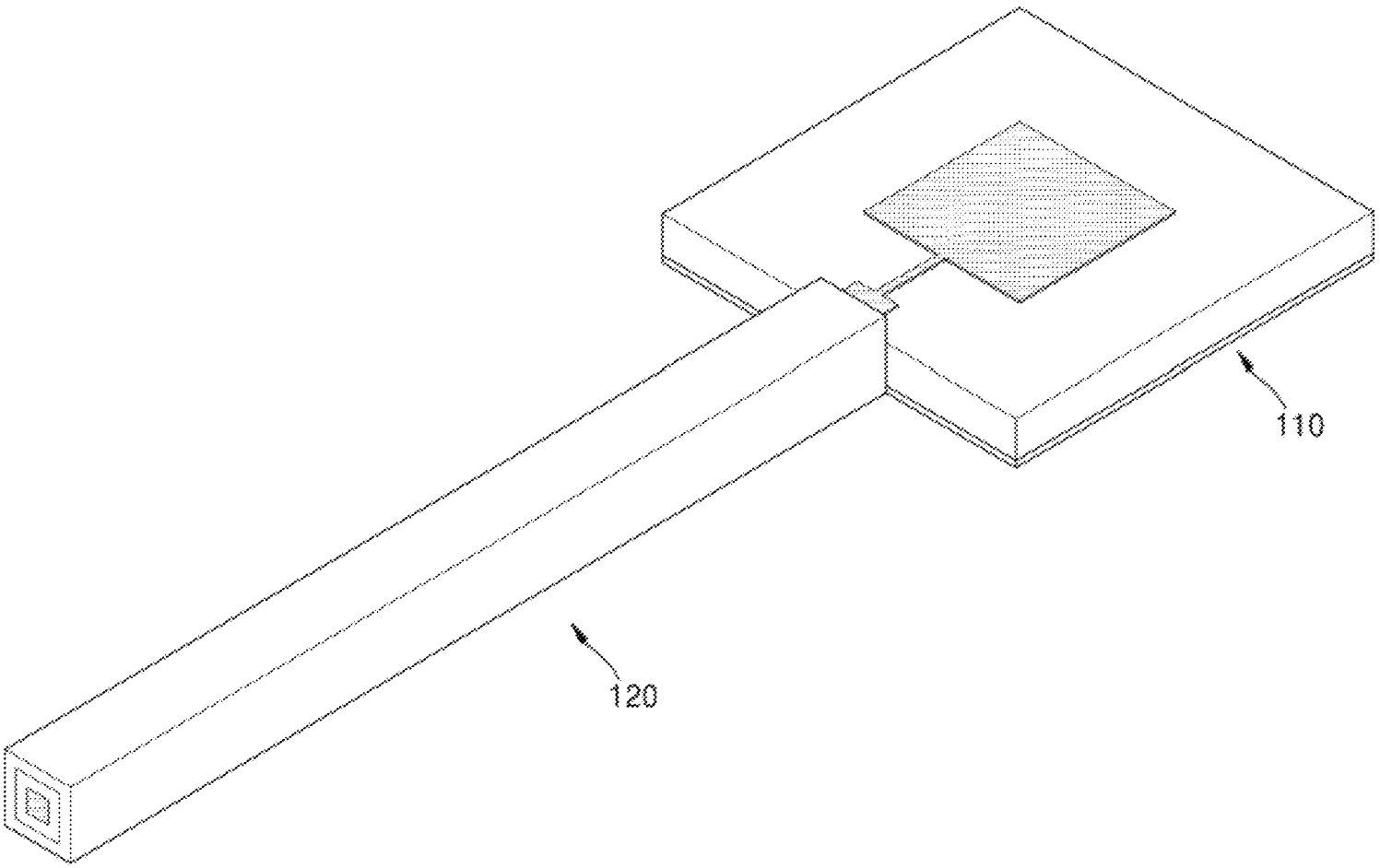
FIG. 1A is a perspective view of a transmission line-integrated patch antenna as one embodiment of an antenna used in a low-loss and flexible curved or orthogonal transmission line-integrated multi-port antenna for an mmWave band according to the present invention.

Hereinafter, exemplary embodiments of the present invention will be described in detail with reference to the attached drawings. Since the embodiments disclosed in the specification and components shown in the drawings are merely exemplary embodiments of the present invention and do not represent an entirety of the technical concept of the present invention, it should be understood that a variety of equivalents and modifications capable of substituting the embodiments and the components may be present at the time of filing of the present application.

A low-loss and flexible curved transmission line-integrated multi port antenna according to an embodiment of the present invention includes low-loss and flexible transmission line-integrated single-port antennas arranged in a variety of structures, for example, a vertical structure and a horizontal structure.

The low-loss and flexible transmission line-integrated single port antenna used as an element of the low-loss and flexible curved transmission line-integrated multi-port antenna for an mmWave band according to the present invention will be described first, and then, the low-loss and flexible curved transmission line-integrated multi-port antenna for an mmWave band according to the present invention will be described.

Figure 1B:
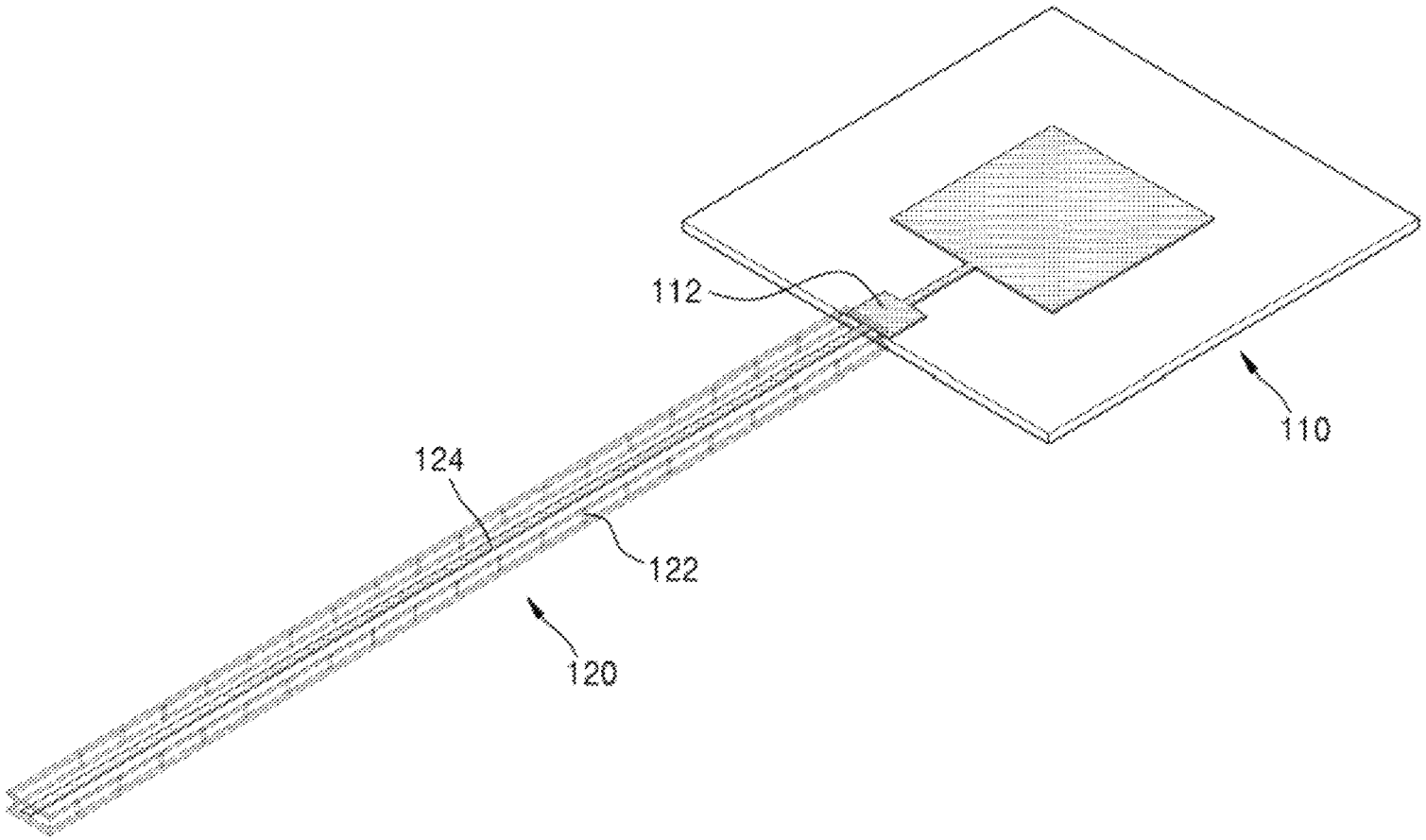
FIG. 1B is a perspective view of a transmission line-integrated antenna utilizing a substrate integrated waveguide (SIW) structure which is applicable to mass production.
Figure 1C:
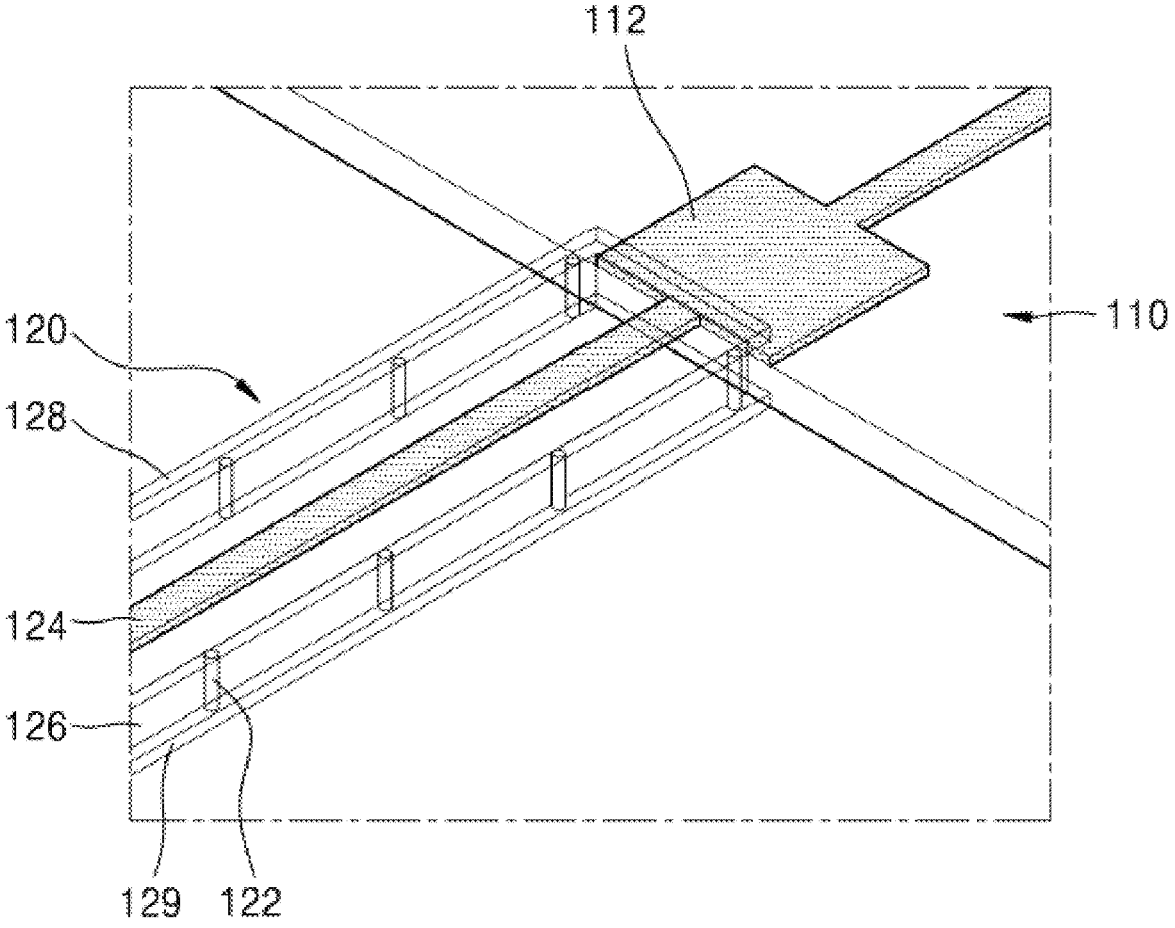
FIG. 1C is an enlarged view of the SIW structure of the transmission line-integrated antenna of FIG. 1B.

FIG. 1A illustrates a transmission line-integrated patch antenna as an example of a low-loss and flexible transmission line-integrated single-port antenna for an mmWave band which is used in one embodiment of the present invention. FIG. 1B illustrates a transmission line-integrated antenna utilizing a substrate integrated waveguide (SIW) structure which is applicable to mass production. FIG. 1C is an enlarged view of the SIW structure of the transmission line-integrated antenna of FIG. 1B.

Figure 2:
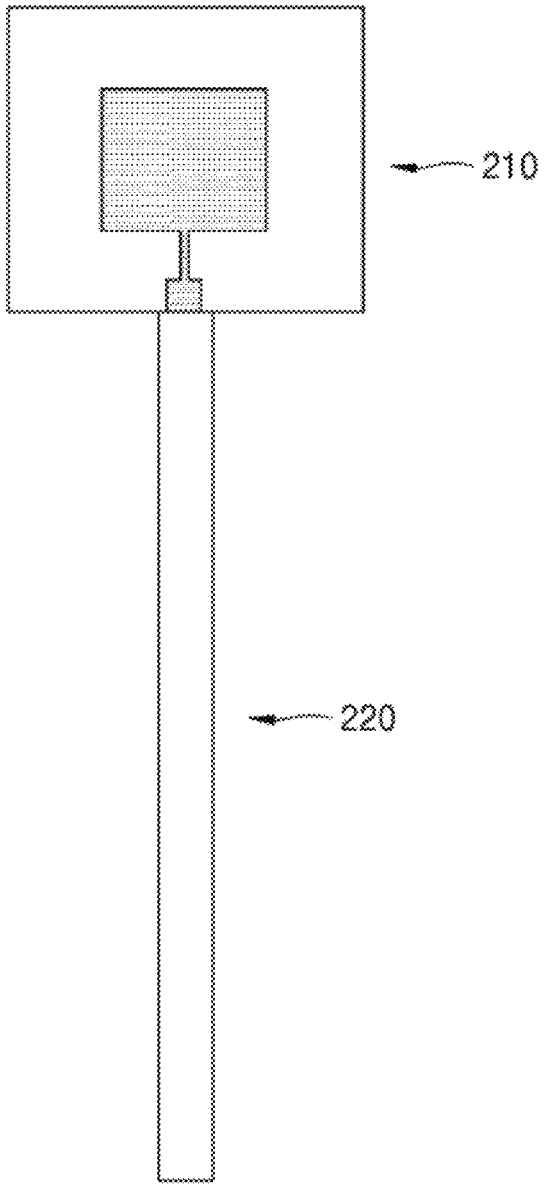
FIG. 2 is a plan view of a low-loss and flexible transmission line-integrated antenna for an mmWave band used as a unit antenna in one embodiment of the present invention.
Figure 3:
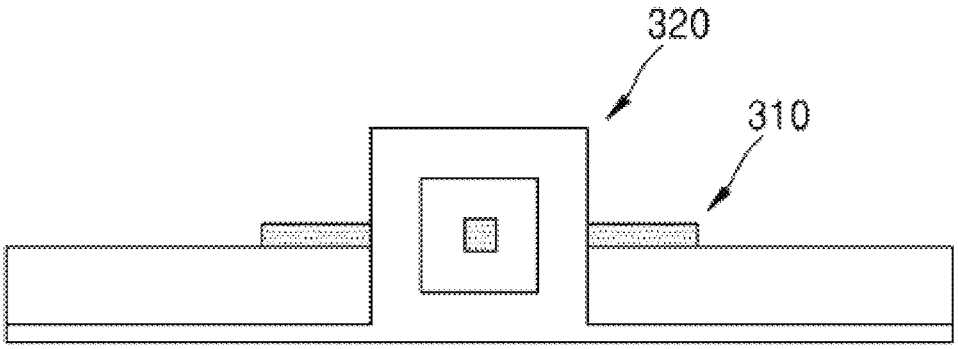
FIG. 3 is a front view of a low-loss and flexible transmission line-integrated antenna for an mmWave band used as a unit antenna in one embodiment of the present invention.

FIG. 2 is a plan view of a transmission line-integrated patch antenna used in one embodiment of the present invention. FIG. 3 is a front view of a transmission line-integrated single-port patch antenna used in one embodiment of the present invention.

Referring to FIGS. 1A to 3, the transmission line-integrated single-port patch antenna used in the embodiments of the present invention includes an antenna 110, 210, or 310 and a transmission line 120, 220, or 320 integrated with the antenna 110, 210, or 310.

Figure 4:
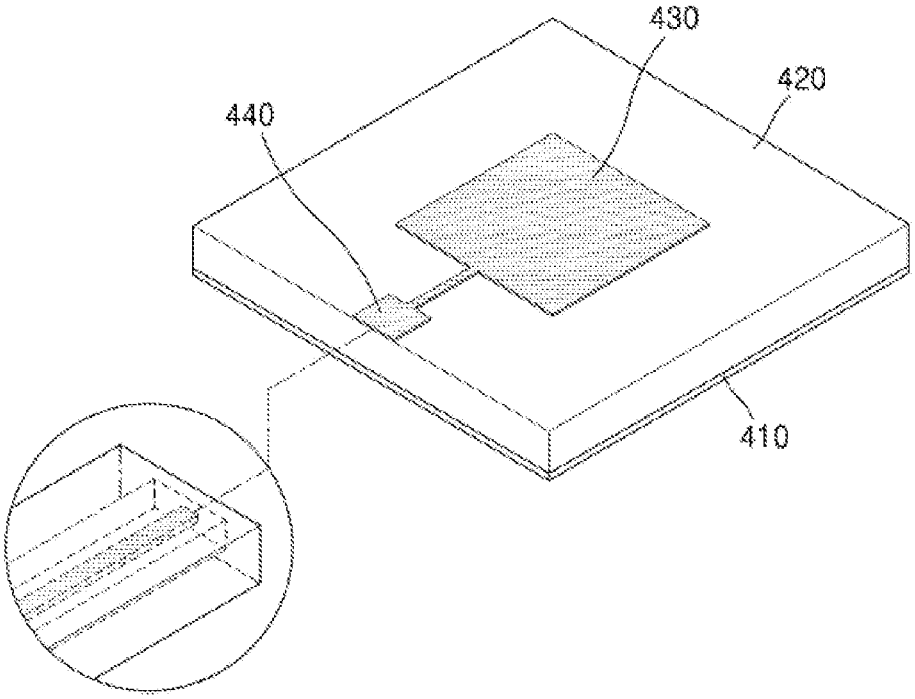
FIG. 4 is a perspective view of a patch antenna used in one embodiment of a low-loss and flexible curved or orthogonal transmission line-integrated multi-port antenna for an mmWave band according to the present invention.
Figure 5:
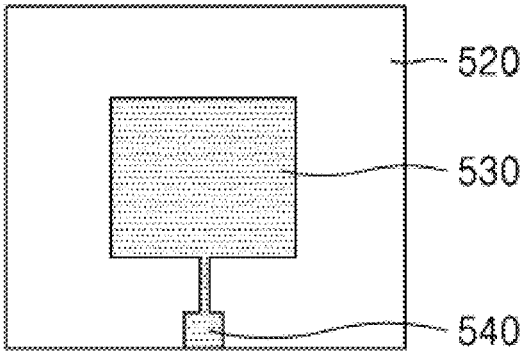
FIG. 5 is a plan view of a patch antenna used in one embodiment of a low-loss and flexible transmission line-integrated antenna for an mmWave band according to the present invention.
Figure 6:
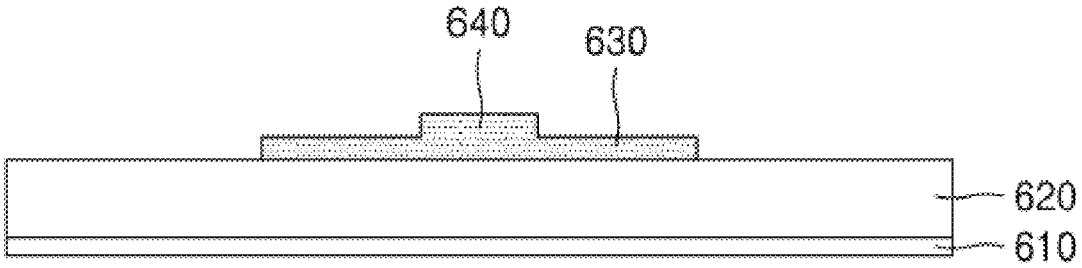
FIG. 6 is a front view of a patch antenna as an example of a low-loss and flexible transmission line-integrated antenna used in a transmission line-integrated multi-port antenna according to the present invention.

FIG. 4 illustrates a patch antenna as an example of the low-loss and flexible transmission line-integrated antenna for an mmWave band which is an element of the present invention. FIG. 5 is a plan view of a patch antenna as an example of the low-loss and flexible transmission line-integrated single-port antenna for an mmWave band which is an element of the present invention. FIG. 6 is a front view of the patch antenna.

Referring to 1A to 6, the patch antenna 110, 210, or 310 includes a ground plate 410 or 610, a dielectric substrate 420, 520, or 620, a signal conversion portion 430, 530, or 630, and an electricity feeding portion 440, 540, or 640.

The ground plate 410 or 610 is located on a bottom surface of the patch antenna 110 or 210, performs a function of a ground, and includes a metal. The dielectric substrate 420, 520, or 620 is formed of a dielectric having a certain thickness on the ground plate 410 or 610.

The signal conversion portion 430, 530, or 630 is formed on the dielectric substrate 420, 520, or 620 and converts an electrical signal of a mobile communication terminal into an electromagnetic wave signal and radiates the electromagnetic wave signal into the air or receives and converts an electromagnetic wave signal in the air into an electrical signal of a mobile communication terminal. The electricity feeding portion 440, 540, or 640 is formed on the dielectric substrate 420, 520, or 620 and is connected to the signal conversion portion 430, 530, or 630.

Figure 7:
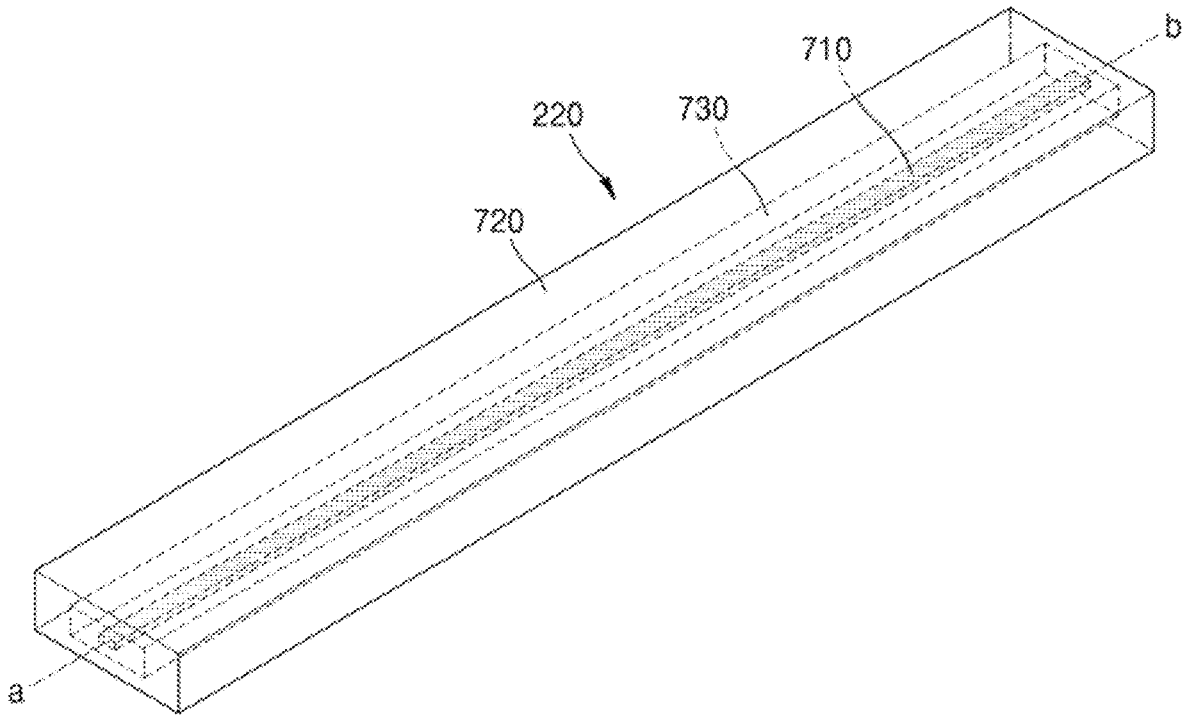
FIG. 7 is a perspective view illustrating a transmission line (flat cable) which is an element of one embodiment of a low-loss and flexible transmission line-integrated antenna for an mmWave band used in a transmission line-integrated multi-port antenna according to the present invention.
Figure 8:
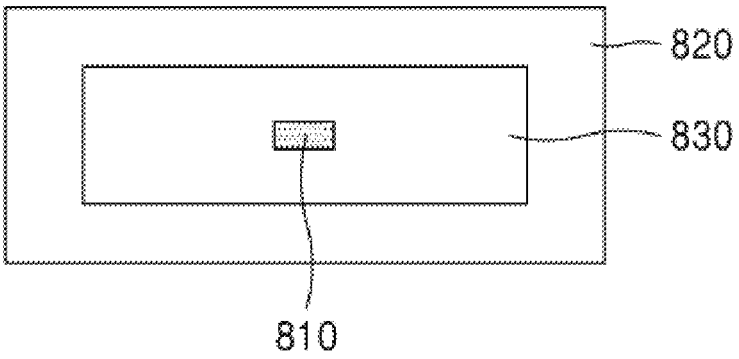
FIG. 8 is a front view of a transmission line which is an element of one embodiment of a low-loss and flexible transmission line-integrated antenna for an mmWave band used in a transmission line-integrated multi-port antenna according to the present invention.

FIG. 7 illustrates a flat cable type transmission line included in one embodiment of the low-loss and flexible transmission line-integrated antenna for an mmWave band which is an element of the present invention. FIG. 8 is a front view illustrating a transmission line (flat cable) included in one embodiment of the low-loss and flexible transmission line-integrated antenna for an mmWave band according to the present invention.

Referring to FIGS. 1A to 8, the transmission line 120, 220, or 320 includes a central conductor 710 or 810, an external conductor 720 or 820, and a dielectric 730 or 830.

One end of the central conductor 710 or 810 is connected to the electricity feeding portion 440, 540, or 640 of the antenna 110, 210, or 310 and transmits, as a signal line, the transmitted or received electrical signal. The external conductor 720 or 820 has the same axis as that of the central conductor 710 or 810 and shields the central conductor 710 or 810 in an axial direction a-b of the central conductor 710 or 810. The dielectric 730 or 830 is formed between the central conductor and the external conductor in the axial direction.

The dielectric substrate 420, 520, or 620 used in the antenna 110, 210, or 310 and the dielectric 730 or 830 used in the transmission line 120, 220, or 320 may have a sheet shape including a nanostructured material formed by electrospinning a resin in a variety of phases (solid, liquid, and gas) at a high voltage.

The nanostructured material is used as a dielectric material included in the antenna and the transmission line in the low-loss and flexible transmission line-integrated antenna for an mmWave band which is an element of the present invention. The dielectric material is formed by selecting an adequate resin among resins in a variety of phases (solid, liquid, and gas) and electrospinning the resin at a certain high voltage and will be referred to as nanoflon hereinafter.

Figure 9:
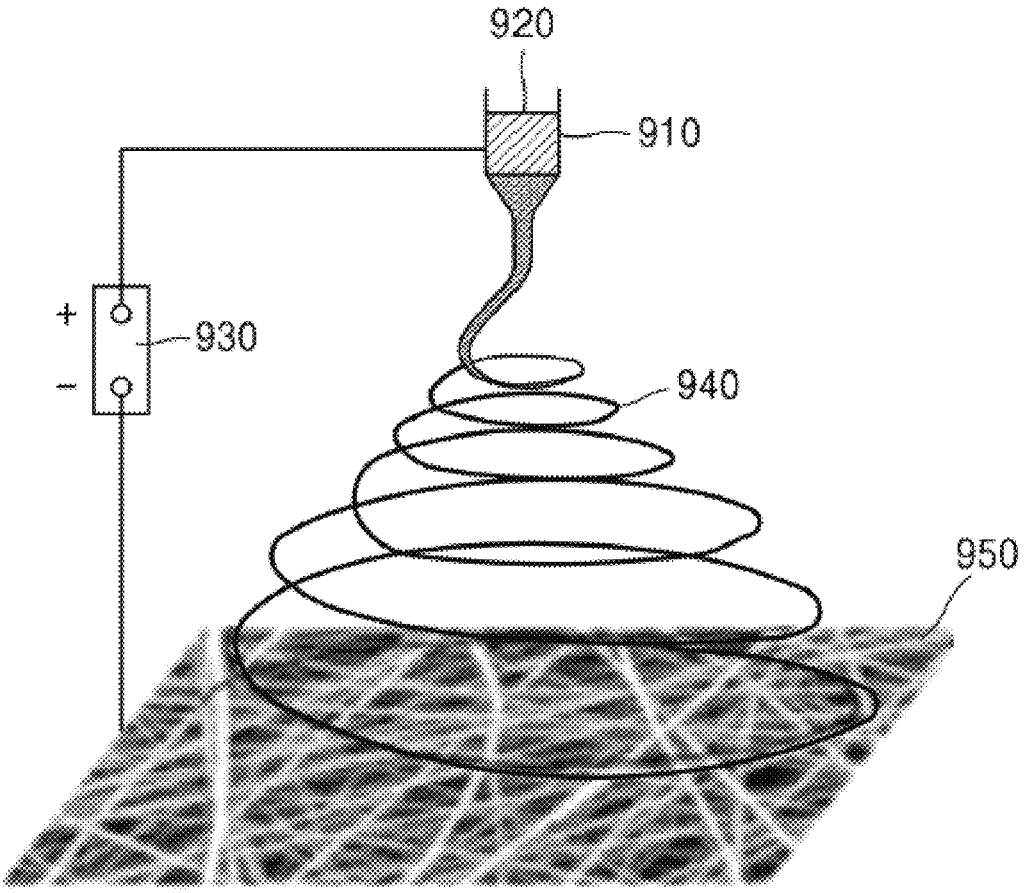
FIG. 9 illustrates an example of an apparatus for manufacturing nanoflon through electrospinning.

FIG. 9 illustrates an example of an apparatus which manufactures nanoflon through electrospinning. When a polymer solution 920 including polymers is injected into an injector 910, a high voltage 930 is applied to a space between the injector 910 and a substrate on which spinning is performed, and the polymer solution flows thereinto at a certain speed, as electricity is applied to a liquid suspended from an end of a capillary due to surface tension, a nanosized thin thread 940 is formed, and as time passes, nanofibers 950 having a non-woven nanostructure are accumulated. A material formed of the accumulated nanofibers as described above is nanoflon. As a polymer material used for electrospinning, for example, there are polycarbonate (PC), polyurethane (PU), polyvinylidene difluoride (PVDF), polyimide (nylon), polyacrylonitrile (PAN), and the like.

Since nanoflon has low dielectric permittivity and a large amount of air, nanoflon may be used as a dielectric of a transmission line and a dielectric substrate of an antenna. A relative dielectric permittivity $\varepsilon r$ of nanoflon used in the present invention is about 1.56, and a dielectric loss tangent value Tan $\delta$ is about 0.0008. In comparison to those of polyimide having a relative dielectric permittivity of 4.3 and a dielectric loss tangent value of 0.004, the relative dielectric permittivity and dielectric loss tangent value of the nanoflon are significantly low. Also, the transmission line-integrated antenna according to the present invention may be flexible and provide flexibility in an installation even in a small space of a smart phone by using a low-loss and flexible material.

Meanwhile, the dielectric used in FIGS. 1A to 8 may be a nanostructured nanosheet dielectric formed by electrospinning a resin in a variety of phases at a high voltage. That is, the dielectric used herein is a low-loss nanosheet material including a lot of air layers between dielectrics which is formed by electrospinning a dielectric resin such as PC, PU, PVDF, polyethersulfone (PES), nylon, PAN, and the like at a high voltage instead of a material including only a dielectric material without an air layer in a dielectric such as existing polyimide (PI) and liquid crystal polymer (LCP)-based materials.

A conductor included in a component of the low-loss and flexible transmission line-integrated antenna for an mmWave band shown in FIGS. 1A to 8 may be formed using a variety of methods such as etching, printing, depositing, and the like. Also, the conductor and the nanosheet dielectric included in the low-loss and flexible transmission line-integrated antenna for an mmWave band shown in FIGS. 1A to 8 include not only a single layer structure but also a multilayer structure in which a plurality of layers are repetitively stacked so as to transmit and receive a multiple signal at the same time. Also, for a bonding structure increasing reliability between the conductor and the nanosheet dielectric, the conductor and the nanosheet dielectric may be connected using a bonding solution or a bonding sheet having a structure having a low relative dielectric permittivity and a low dielectric loss of a thin film layer.

Also, the low-loss and flexible transmission line-integrated single-port antenna used as an element of to the present invention includes a microstrip patch signal radiator, a variety of shapes of patch type antenna radiator structures, or a diagonal line type patch antenna structure. An antenna radiator patch may be located on an uppermost end surface, a nanosheet dielectric having a certain thickness may be formed on a bottom surface of the antenna radiator patch, and a ground plate formed of a metal may be formed on a lowermost end surface. Particularly, for efficient combination between each conductor and the nanosheet dielectric, a bonding force may be reinforced using a low-loss dielectric bonding sheet or a bonding solution and a conductor vapor-deposited on a nanosheet dielectric may be utilized.

Also, as an antenna and a transmission line to be integrated with the antenna in the low-loss and flexible transmission line-integrated single-port antenna, mutually equal nanosheet dielectrics may be used as dielectrics. Referring to FIG. 1C, the transmission line 120 includes a nanosheet dielectric 126 having a certain thickness, conductors 128 and 129 formed on a top surface and a bottom surface of the nanosheet dielectric 126, and a stripline signal line 124 formed as a signal line in centers of the nanosheet dielectric 126 and the conductors 128 and 129. A plurality of via holes 122 may be formed between a surface of the conductor 128 formed above the nanosheet dielectric 126 and a surface of the conductor 129 formed below the nanosheet dielectric 126. That is, the low-loss and flexible transmission line-integrated antenna according to the present invention may include a stripline structure in which the plurality of via holes 122 are formed along a longitudinal edge of the transmission line 120 in a direction parallel to the signal line 124. The stripline signal line 124 is directly connected to a radiator patch conductor 112 of the antenna.

The plurality of via holes 122 are configured to prevent a leakage from the signal line and transmission/reception of noise and provides an excellent noise cut property with respect to a broadband including an mmWave band using an SIW structure.

Figure 10:
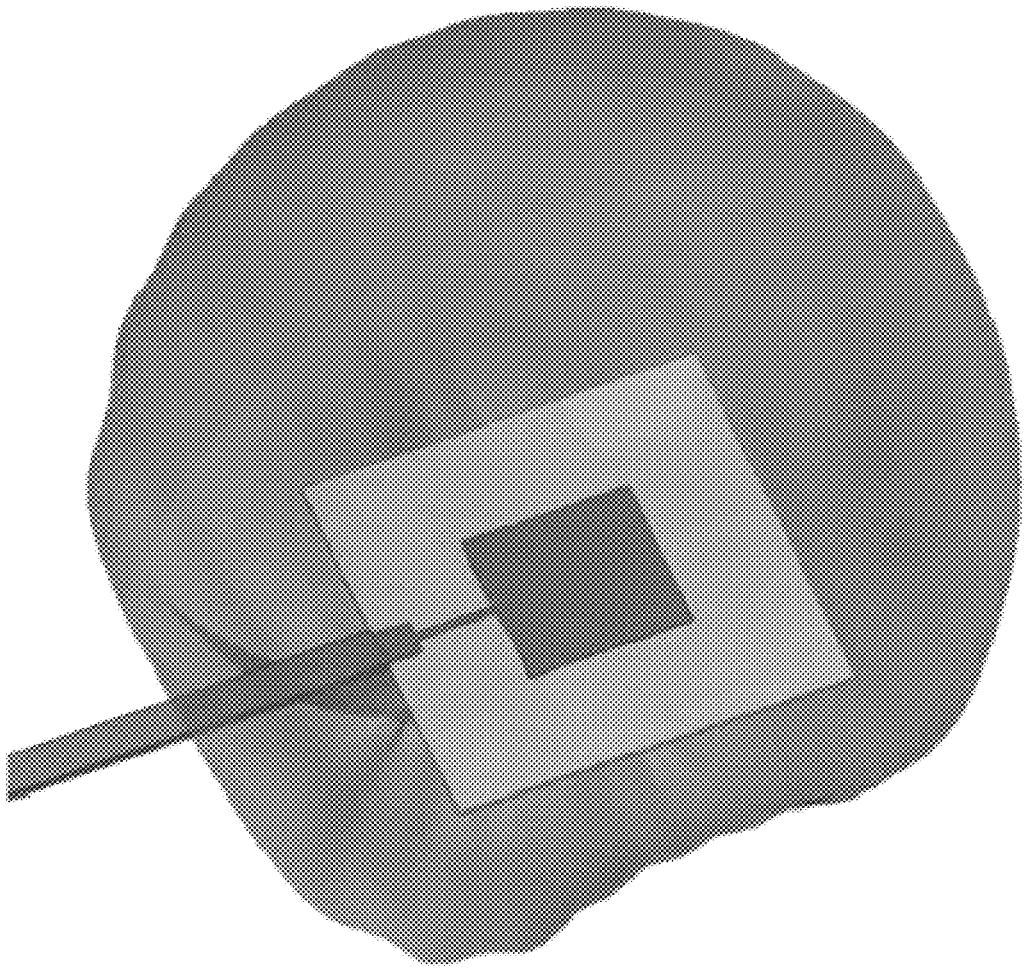
FIG. 10 illustrates a beam pattern (radiation pattern) of a transmission line-integrated patch antenna as an example of a low-loss and flexible transmission line-integrated antenna for an mmWave band used in a multi-port antenna according to the present invention.

FIG. 10 illustrates a beam pattern (radiation pattern) of a transmission line-integrated patch antenna as an example of the low-loss and flexible transmission line-integrated single-port antenna for an mmWave band used in the low-loss and flexible transmission line-integrated multi-port antenna according to the present invention. The beam pattern is an electric field strength of a radiated electromagnetic wave and indicates directivity as shown in FIG. 10.

Figure 11:
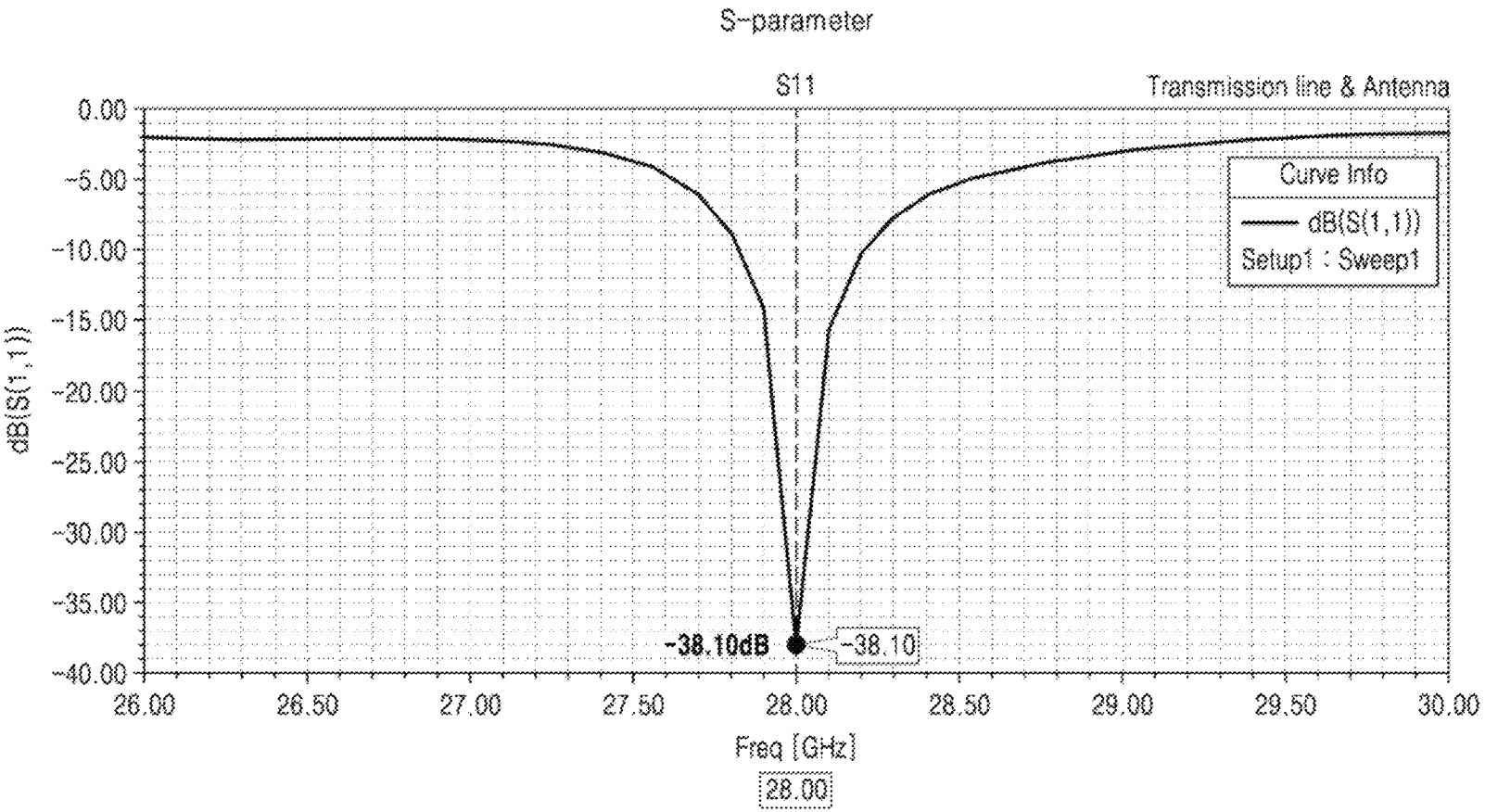
FIG. 11 illustrates an input reflection coefficient S11 according to a frequency of a transmission line-integrated patch antenna as an example of a low-loss and flexible transmission line-integrated antenna for an mmWave band used in a transmission line-integrated multi-port antenna according to the present invention.

FIG. 11 illustrates an input reflection parameter S11 according to a frequency of a transmission line-integrated patch antenna as an example of a low-loss and flexible transmission line-integrated antenna for an mmWave band used in a transmission line-integrated multi-port antenna according to the present invention. Referring to FIG. 11, it may be seen that, in the transmission line-integrated patch antenna according to one embodiment of the present invention, a value of S11 decreases and signal power input into the antenna is reflected, does not return, is maximally radiated outside through the antenna, has high radiation efficiency, and is well matched at a frequency of 28 GHz that is a 5G communication frequency.

Figure 12:
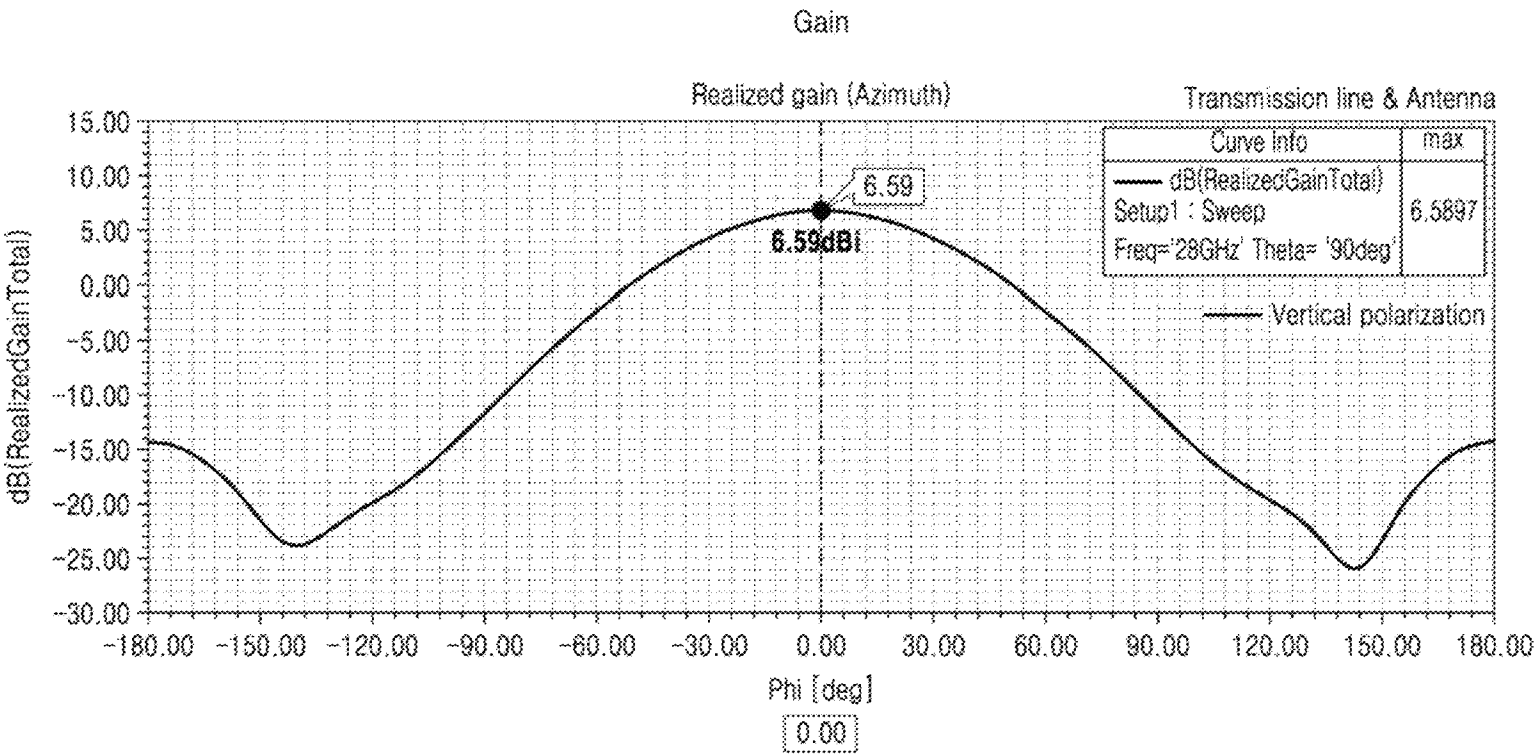
FIG. 12 illustrates a gain property of a transmission line-integrated patch antenna as an example of the low-loss and flexible transmission line-integrated antenna for an mmWave band used in the transmission line-integrated multi-port antenna according to the present invention.

FIG. 12 illustrates a gain property of a transmission line-integrated patch antenna as an example of the low-loss and flexible transmission line-integrated antenna for an mmWave band used in the transmission line-integrated multi-port antenna according to the present invention. Referring to FIG. 12, it may be seen that a gain property of vertical polarization is about 6.6 dBi at 0 radian which is a very high antenna gain property.

Meanwhile, the low-loss and flexible transmission line-integrated single-port antenna for an mmWave band used in the embodiment of the present invention includes not only a patch antenna or a microstrip patch antenna but also an antenna and a transmission line using dielectrics. For example, the antenna used as an element of the present invention may be formed in the form of a dipole antenna or a monopole antenna. Also, the antenna is a built-in antenna built in a mobile communication terminal and may be applied to a planar inverted F antenna (PIFA).

Figure 13:
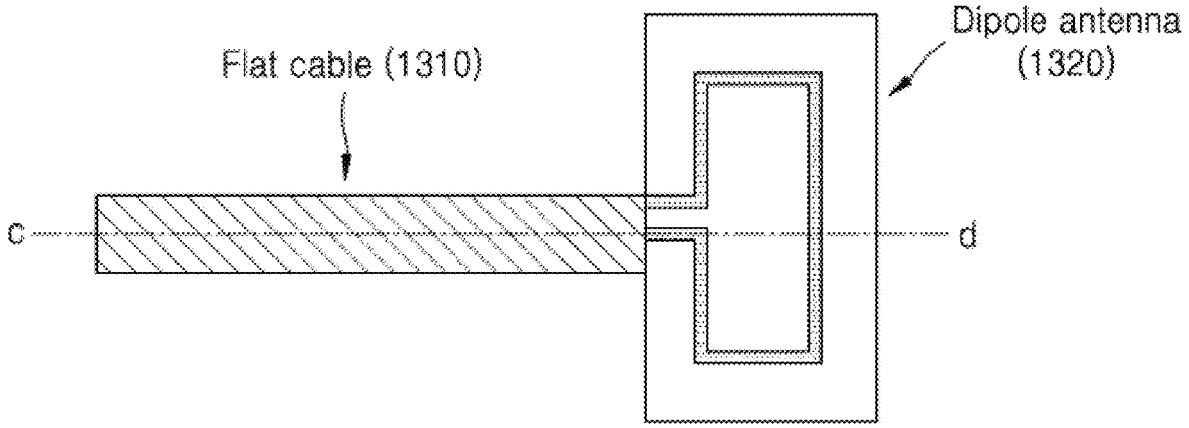
FIG. 13 is a plan view of a transmission line-integrated dipole antenna as an example of the low-loss and flexible transmission line-integrated antenna for an mmWave band used in the transmission line-integrated multi-port antenna according to the present invention.
Figure 14:
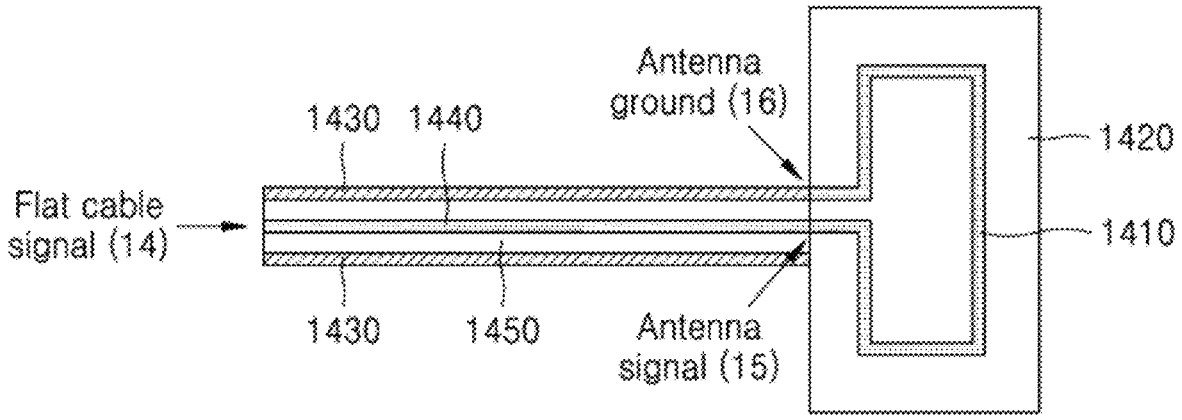
FIG. 14 is an axial cross-sectional view of a transmission line-integrated dipole antenna as an example of the low-loss and flexible transmission line-integrated antenna for an mmWave band used in the present invention.

FIG. 13 is a plan view of a transmission line-integrated dipole antenna as another example of the low-loss and flexible transmission line-integrated single-port antenna for an mmWave band used in the embodiment of the present invention. FIG. 14 is an axial (c-d of FIG. 13) cross-sectional view of a transmission line-integrated dipole antenna as another example of a low-loss and flexible transmission line-integrated single-port antenna for an mmWave band used in an embodiment according to the present invention.

Referring to FIGS. 13 and 14, the transmission line-integrated dipole antenna includes a flat cable 1310 that is a transmission line and a dipole antenna 1320 integrated with the flat cable 1310. Also, the dipole antenna 1320 includes a dipole type signal conversion portion 1410 and a dielectric 1420, and the transmission line 1310 includes a central conductor 1440 which transmits a signal, an external conductor 1430, and a dielectric 1450 which is formed of a dielectric material having a low dielectric permittivity and a low loss between the central conductor and the external conductor.

The transmission line-integrated dipole antenna usable in the embodiment of the present invention includes one end 15 connected to a signal line of the flat cable which is the transmission line 1310 and another end 16 connected to a ground line of the antenna.

Figure 15:
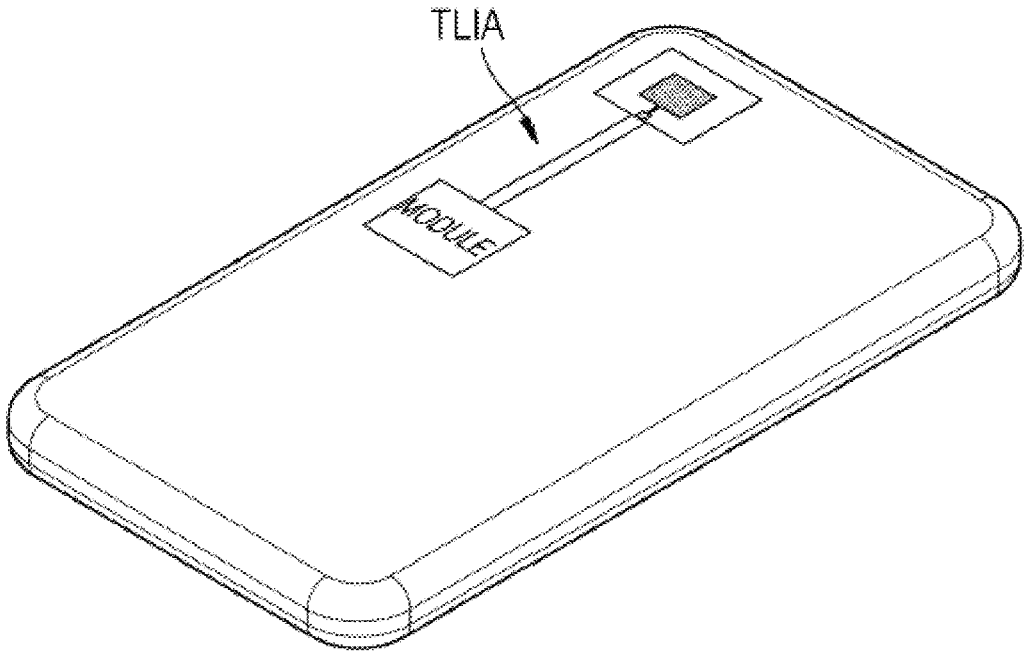
FIG. 15 illustrates an example of a mobile communication device in which the low-loss and flexible transmission line-integrated single-port antenna for an mmWave band used in the embodiment of the present invention is mounted.

Also, FIG. 15 illustrates an example of a mobile communication device in which the low-loss and flexible transmission line-integrated single-port antenna for an mmWave band used in the embodiment of the present invention is mounted; Referring to FIG. 15, the mobile communication device includes a low-loss and flexible transmission line-integrated single-port antenna TLIA for an mmWave band according to the present invention which is connected to a circuit module of the mobile communication device, transmits and receives electrical signals, and externally radiates electromagnetic waves through an antenna.

Meanwhile, the low-loss and flexible curved transmission line-integrated multi-port antenna for an mmWave band according to the present invention which includes the above-described low-loss and flexible transmission line-integrated single-port antennas will be described.

Figure 16:
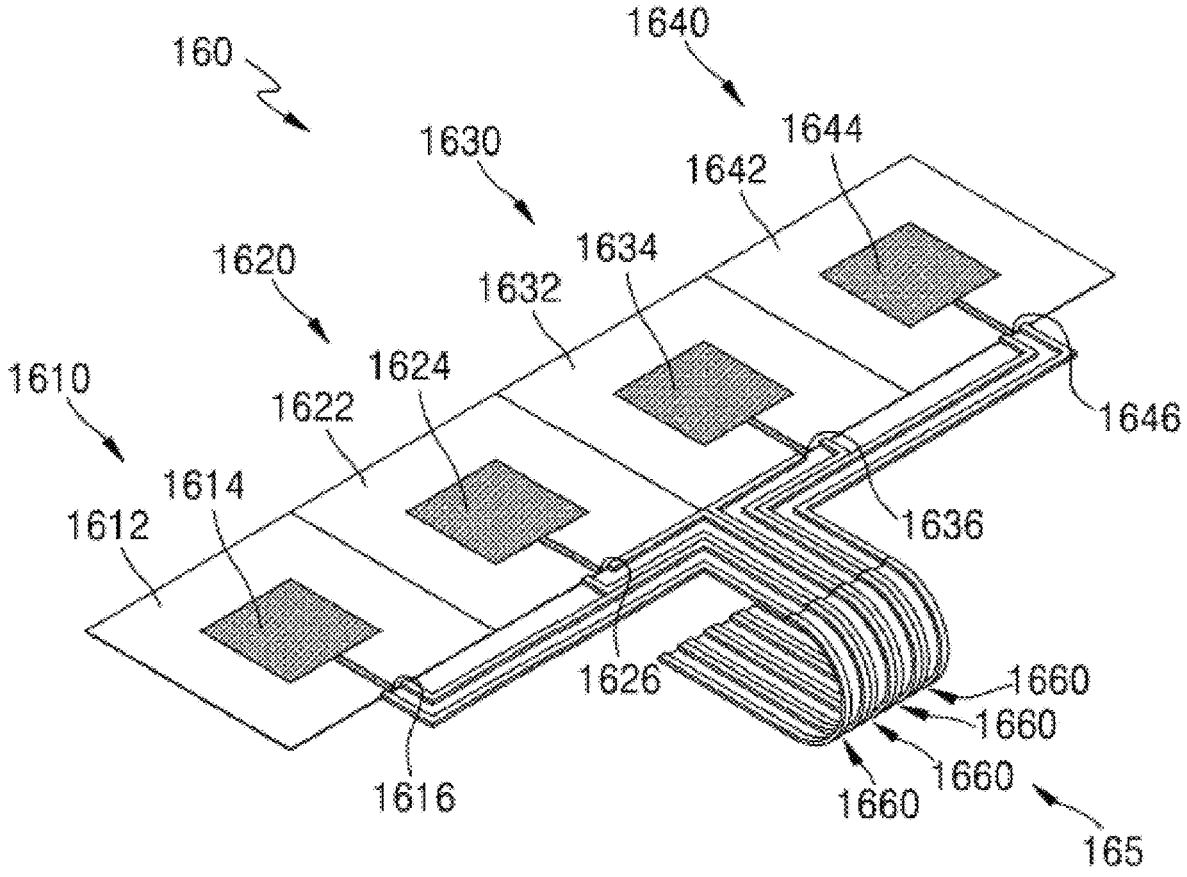
FIG. 16 illustrates one embodiment of the low-loss and flexible curved transmission line-integrated multi-port antenna for an mmWave band according to the present invention.
Figure 17:
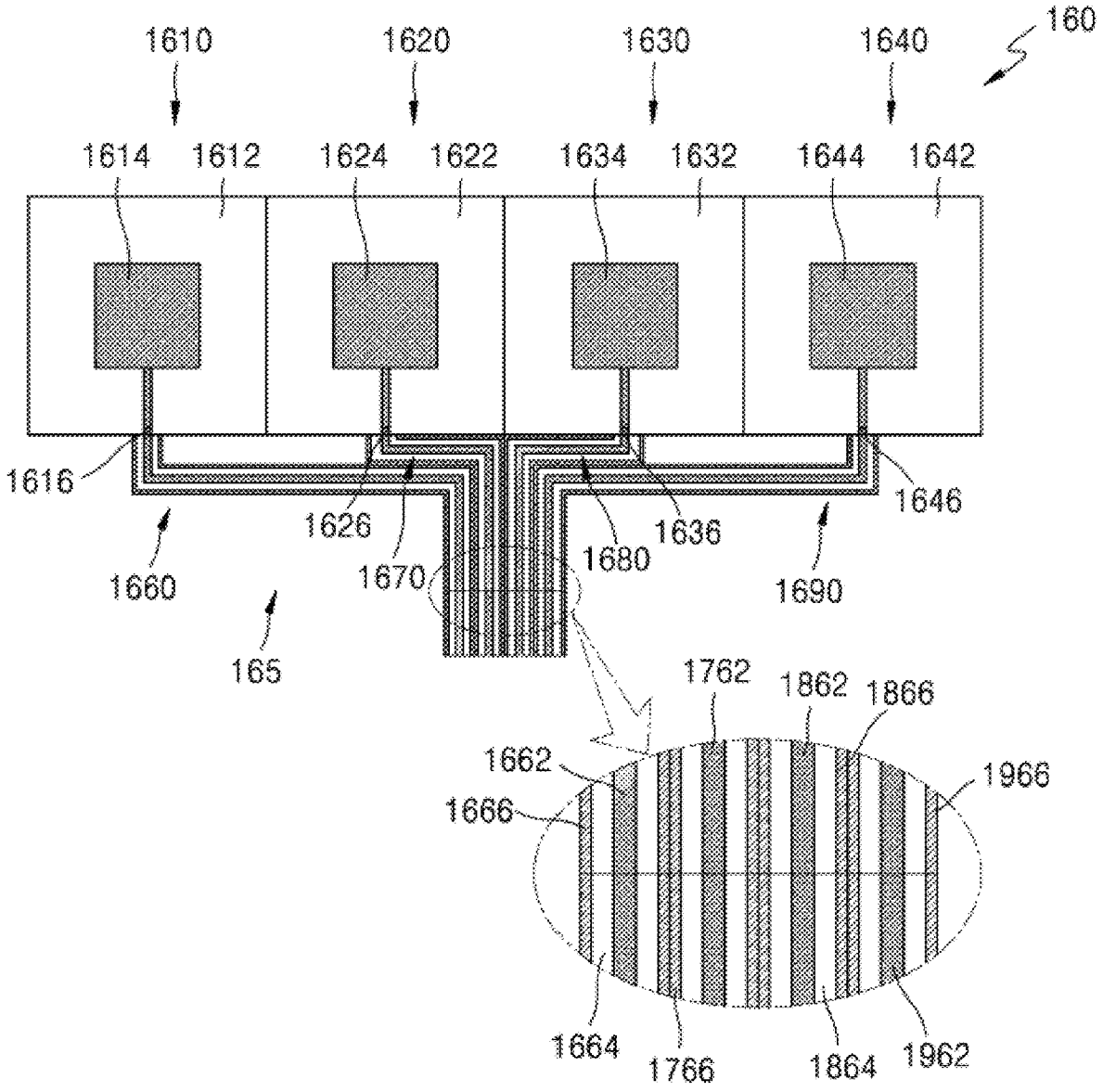
FIG. 17 is a plan view illustrating one embodiment of the low-loss and flexible curved transmission line-integrated multi-port antenna for an mmWave band according to the present invention.
Figure 18:
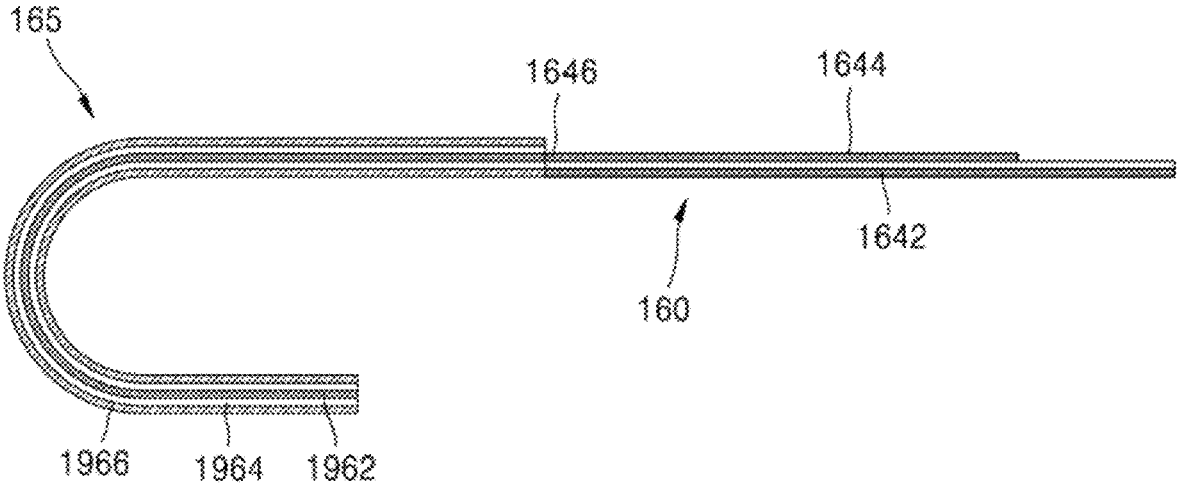
FIG. 18 is a side view illustrating one embodiment of the low-loss and flexible curved transmission line-integrated multi-port antenna for an mmWave band according to the present invention.

FIG. 16 illustrates one embodiment of the low-loss and flexible curved transmission line-integrated multi-port antenna for an mmWave band according to the present invention. FIG. 17 is a plan view illustrating one embodiment of the low-loss and flexible curved transmission line-integrated multi-port antenna for an mmWave band according to the present invention. FIG. 18 is a side view illustrating one embodiment of the low-loss and flexible curved transmission line-integrated multi-port antenna for an mmWave band according to the present invention.

Referring to FIGS. 16 to 18, the low-loss and flexible curved transmission line-integrated multi-port antenna according to one embodiment of the present invention includes a multi-port antenna portion 160 and a transmission line portion 165.

The multi-port antenna portion 160 includes a plurality of single antennas 1610, 1620, 1630, and 1640 and forms multi-ports, for example, four ports. Each of the single antennas forms one port.

The transmission line portion 165 includes a plurality of transmission lines 1660, 1670, 1680, and 1690 which correspond to the single antennas 1610, 1620, 1630, and 1640, respectively, and have a curved shape. Central conductors 1662, 1762, 1862, and 1962 used as signal lines of the respective transmission lines are integrated with corresponding electricity feeding portions 1616, 1626, 1636, and 1646 of the single antennas, respectively.

As described above with reference to FIGS. 1A to 18, each of the plurality of antennas 1610, 1620, 1630, and 1640 includes a dielectric substrate 1612, 1622, 1632, 1642, 420, 520, or 620, a signal conversion portion 1614, 1624, 1634, 1644, 430, 530, or 630, and the electricity feeding portion 1616, 1626, 1636, 1646, 440, 540, or 640.

The dielectric substrate 1612, 1622, 1632, 1642, 420, 520, or 620 is formed of a dielectric having a certain thickness on the ground plate 410 or 610. The signal conversion portion 1614, 1624, 1634, 430, 530, or 630 is formed on the dielectric substrate 1612, 1622, 1632, 1642, 420, 520, or 620 and converts an electrical signal of the mobile communication device into an electromagnetic wave signal and radiates the electromagnetic wave signal into the air or receives and converts an electromagnetic wave signal in the air into an electrical signal of a mobile communication device. The electricity feeding portion 1616, 1626, 1636, 1646, 440, 540, or 640 is formed on the dielectric substrate 1612, 1622, 1632, 1642, 420, 520, or 620) and connected to the signal conversion portion 1614, 1624, 1634, 1644, 430, 530, or 630.

Also, each of the plurality of transmission lines 1660, 1670, 1680, and 1690 includes the central conductor 1662, 1762, 1862, 1962, 710, or 810, external conductor 1666, 1766, 1866, 1966, 720 or 820, and the dielectric 1664, 1764, 1864, 1964, 730 or 830.

One end of the central conductor 1662, 1762, 1862, 1962, 710 or 810 is integrated with the electricity feeding portion 1616, 1626, 1636, 1646, 440, 540, or 640 of the single antenna and transfers the transmitted or received electrical signal.

The external conductor 1666, 1766, 1866, 1966, 720 or 820 has the same axis as that of the central conductor 1662, 1762, 1862, 1962, 710, or 810 and shields the central conductor 1662, 1762, 1862, 1962, 710, or 810 in an axial direction of the central conductor 1662, 1762, 1862, 1962, 710, or 810.

The dielectric 1664, 1764, 1864, 1964, 730 or 830 is formed between the central conductor 1662, 1762, 1862, 1962, 710, or 810 and the external conductor 1666, 1766, 1866, 1966, 720 or 820 in the axial direction.

The dielectric 1664, 1764, 1864, 1964, 730 or 830 may be a nanostructured sheet material formed by electrospinning a resin at a high voltage as described above with reference to FIG. 9. A beam pattern (radiation pattern) of the plurality of single antennas 1610, 1620, 1630, and 1640 may include circular polarization.

Figure 19:
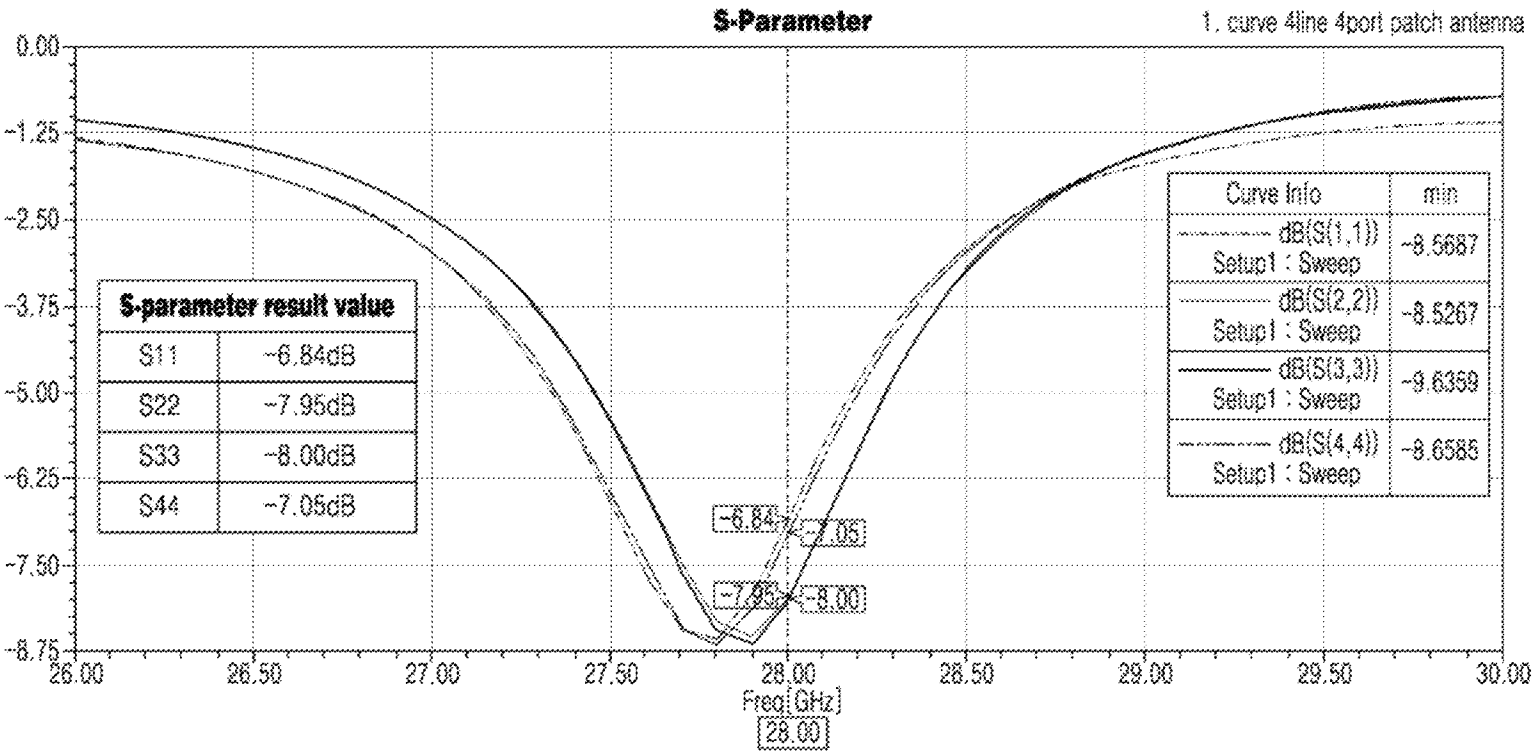
FIG. 19 illustrates a property of an input reflection parameter S11 according to a frequency of one example of the low-loss and flexible curved transmission line-integrated multi-port antenna for an mmWave band according to the present invention.

FIG. 19 illustrates a property of an input reflection parameter S11 according to a frequency of one example of the low-loss and flexible curved transmission line-integrated multi-port antenna for an mmWave band according to the present invention. Referring to FIG. 19, it may be seen that the transmission line-integrated multi-port patch antenna according to one embodiment of the present invention has excellent impedance and an excellent reflection parameter with respect to signal power input into the antenna at a frequency of 28 GHz which is a 5G communication frequency.

Figure 20:
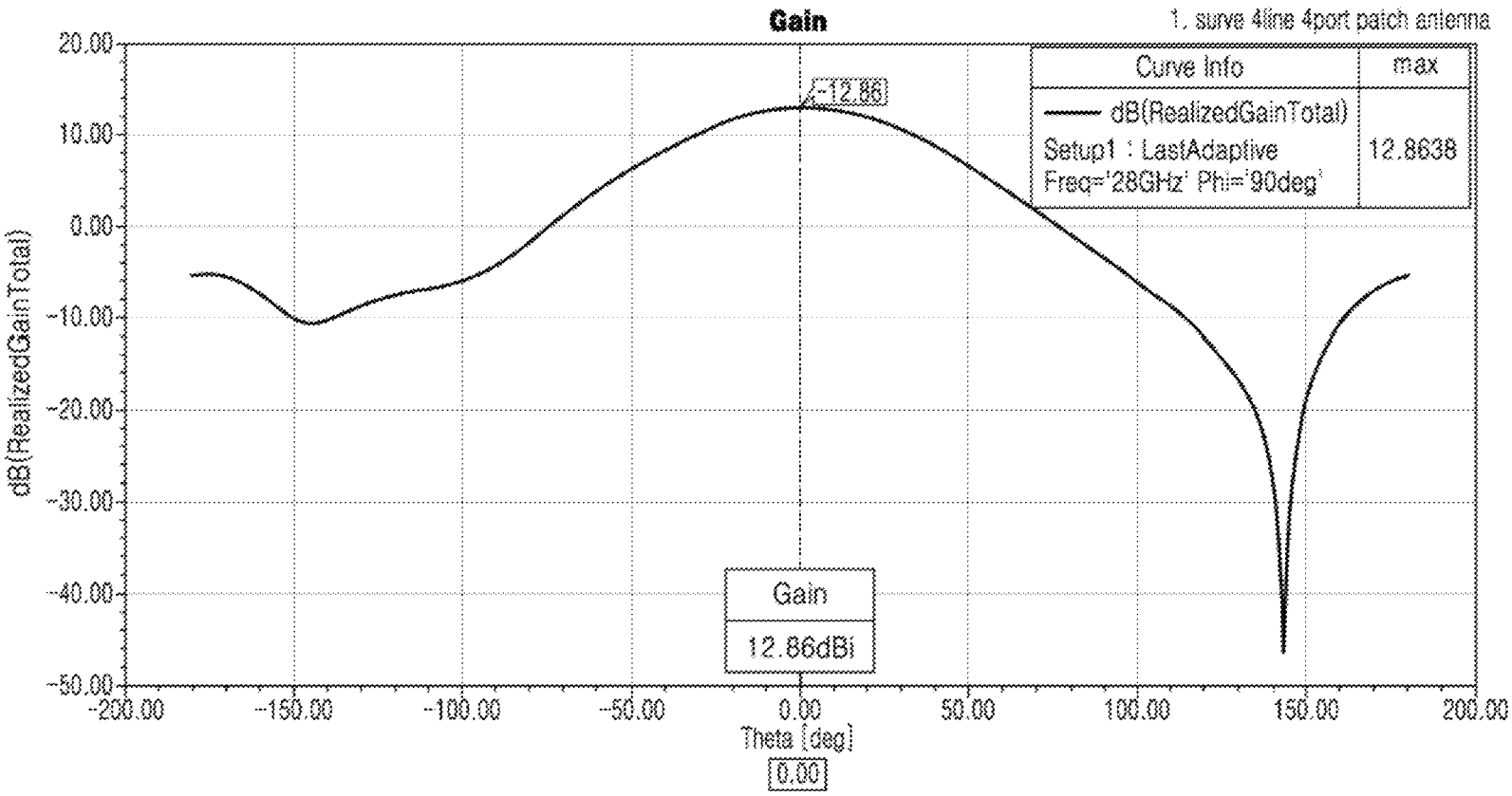
FIG. 20 illustrates a gain property of one example of the low-loss and flexible curved transmission line-integrated multi-port antenna for an mmWave band according to the present invention.

FIG. 20 illustrates a gain property of one example of the low-loss and flexible curved transmission line-integrated multi-port antenna for an mmWave band according to the present invention. Referring to FIG. 20, it may be seen that when an input signal is applied to the multi port, a gain property of vertical polarization is about 12.86 dBi at 0 radian which is a very high antenna gain property.

Meanwhile, the low-loss and flexible curved transmission line-integrated multi-port antenna for an mmWave band according to the embodiment of the present invention may be used while being mounted in a 5G mobile communication device.

Figure 21:
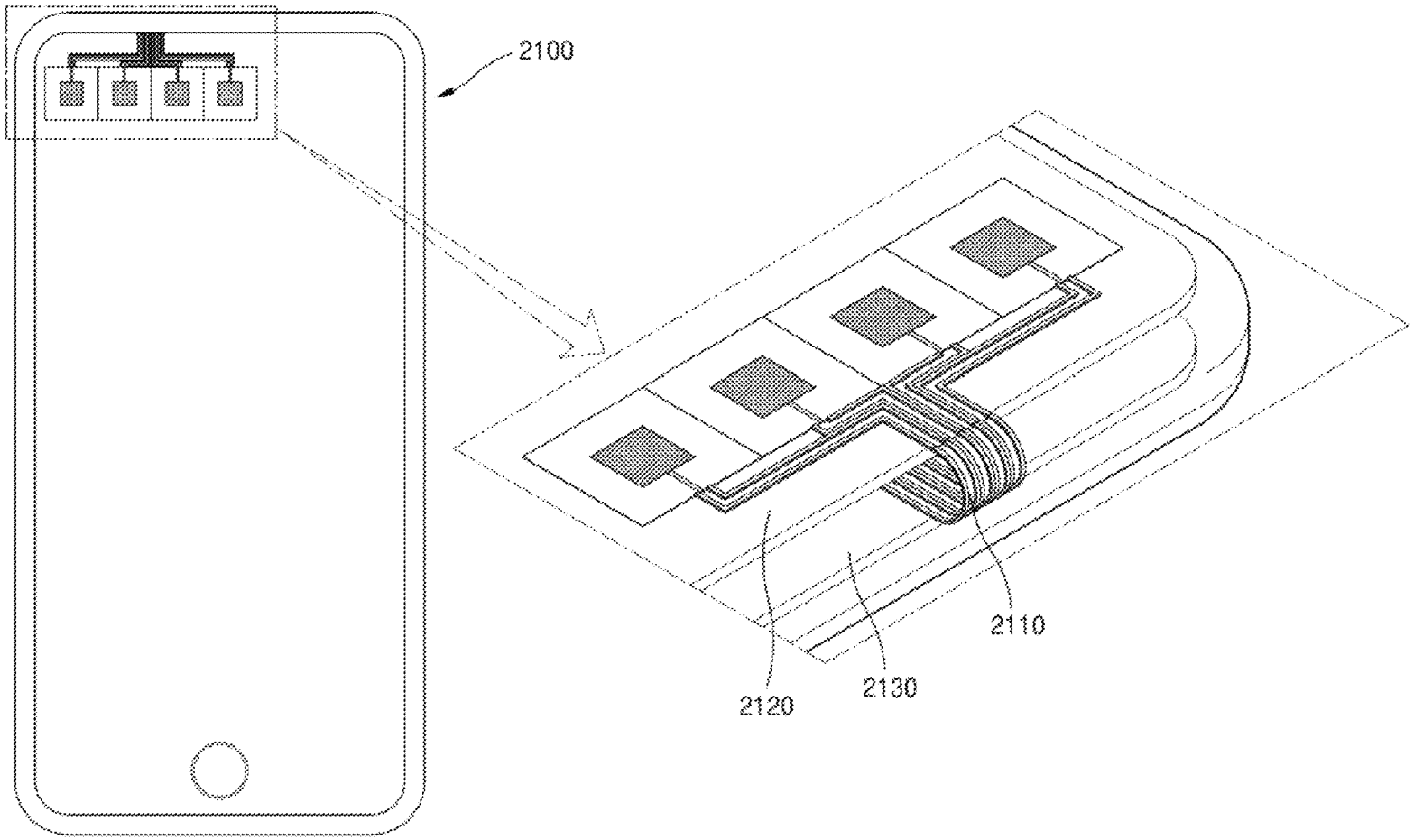
FIG. 21 illustrates a mobile communication device in which a low-loss and flexible curved transmission line-integrated multi-port antenna for an mmWave band according to an embodiment of the present invention is mounted.
Figure 22:
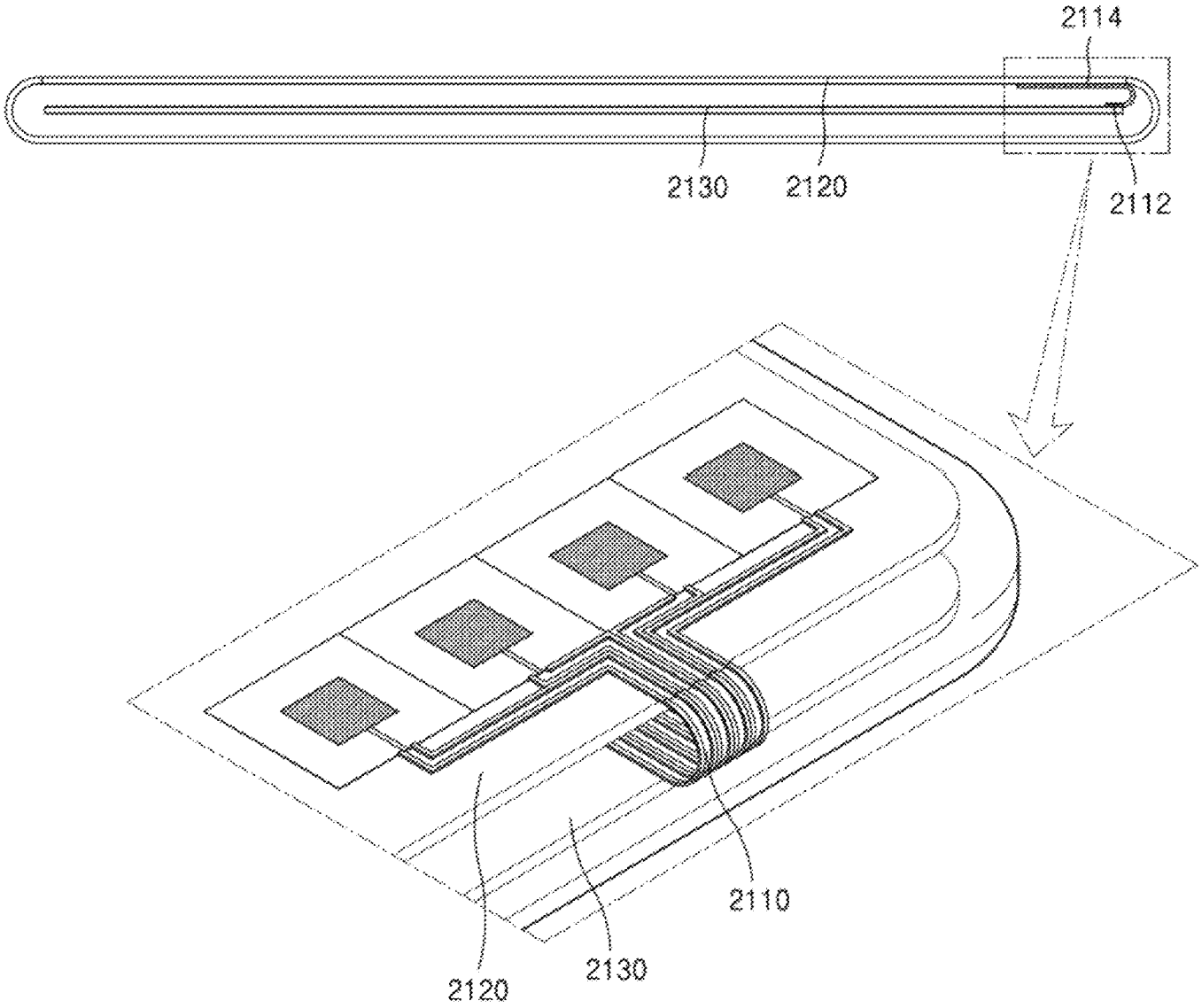
FIG. 22 is a side view of the mobile communication device in which the low-loss and flexible curved transmission line-integrated multi-port antenna for an mmWave band according to the embodiment of the present invention is mounted.

FIG. 21 illustrates a mobile communication device in which a low-loss and flexible curved transmission line-integrated multi-port antenna for an mmWave band according to an embodiment of the present invention is mounted. FIG. 22 is a side view of the mobile communication device in which the low-loss and flexible curved transmission line-integrated multi-port antenna for an mmWave band according to the embodiment of the present invention is mounted.

Referring to FIGS. 21 and 22, in a low-loss and flexible curved transmission line-integrated multi-port antenna for an mmWave band according to an embodiment of the present invention, a curved lower surface 2112 of a transmission line is located above a printed circuit board (PCB) 2130 of a mobile communication device 2100 and an upper surface 2114 of the transmission line is located on an inner surface of a mobile communication device case 2120.

Figure 23:
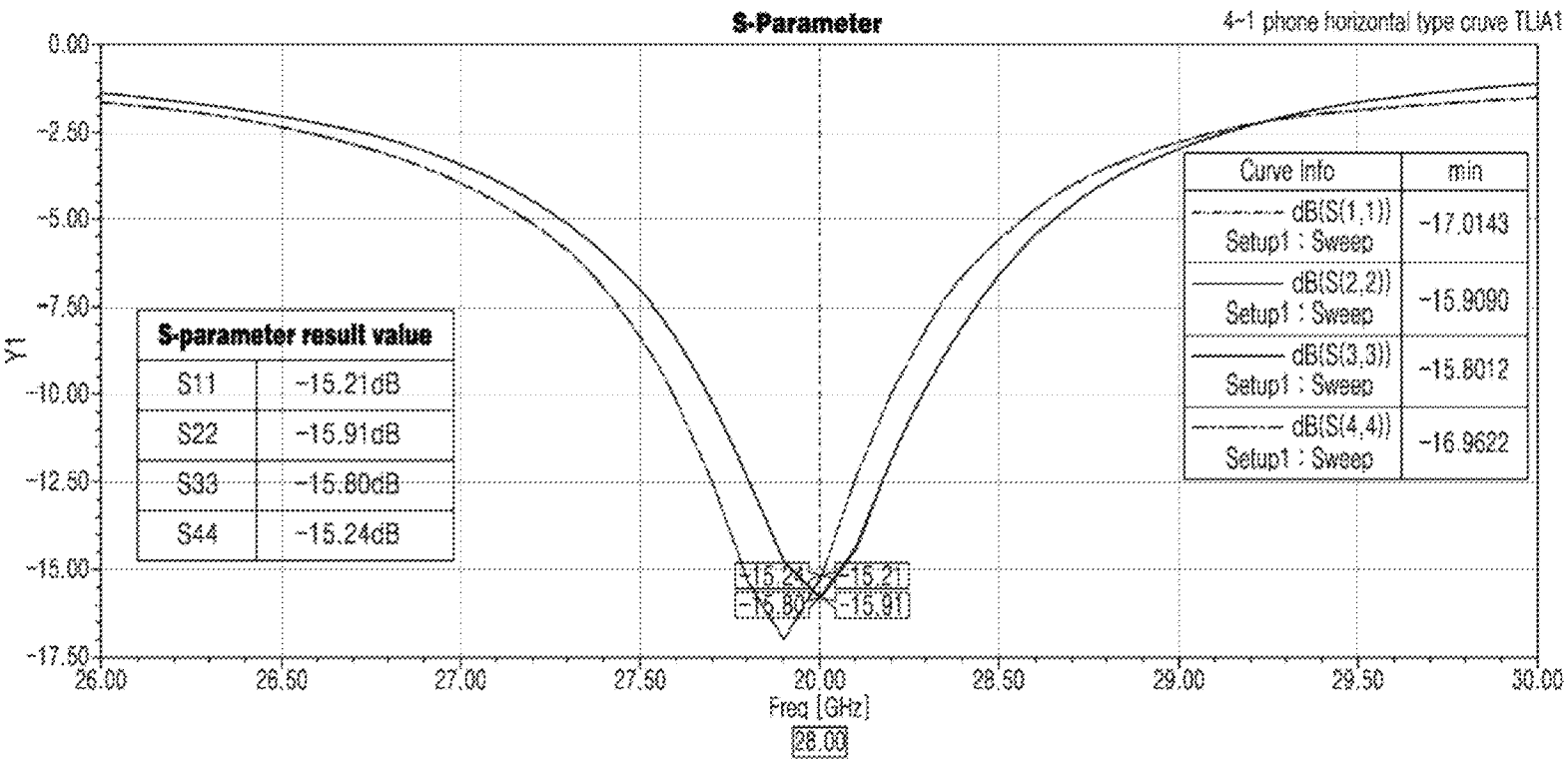
FIG. 23 illustrates properties of input reflection parameters S11, S22, S33, and S44 according to a frequency of one example of the mobile communication device in which the low-loss and flexible curved transmission line-integrated multi-port antenna for an mmWave band according to the present invention is mounted.

FIG. 23 illustrates properties of input reflection parameters S11, S22, S33, and S44 according to a frequency of one example of the mobile communication device in which the low-loss and flexible curved transmission line-integrated multi-port antenna for an mmWave band according to the present invention is mounted. Referring to FIG. 23, it may be seen that the transmission line-integrated multi-port patch antenna according to one embodiment of the present invention has excellent impedance and an excellent reflection parameter with respect to signal power input into the antenna on the basis of a frequency of 28 GHz which is a 5G communication frequency.

Figure 24:
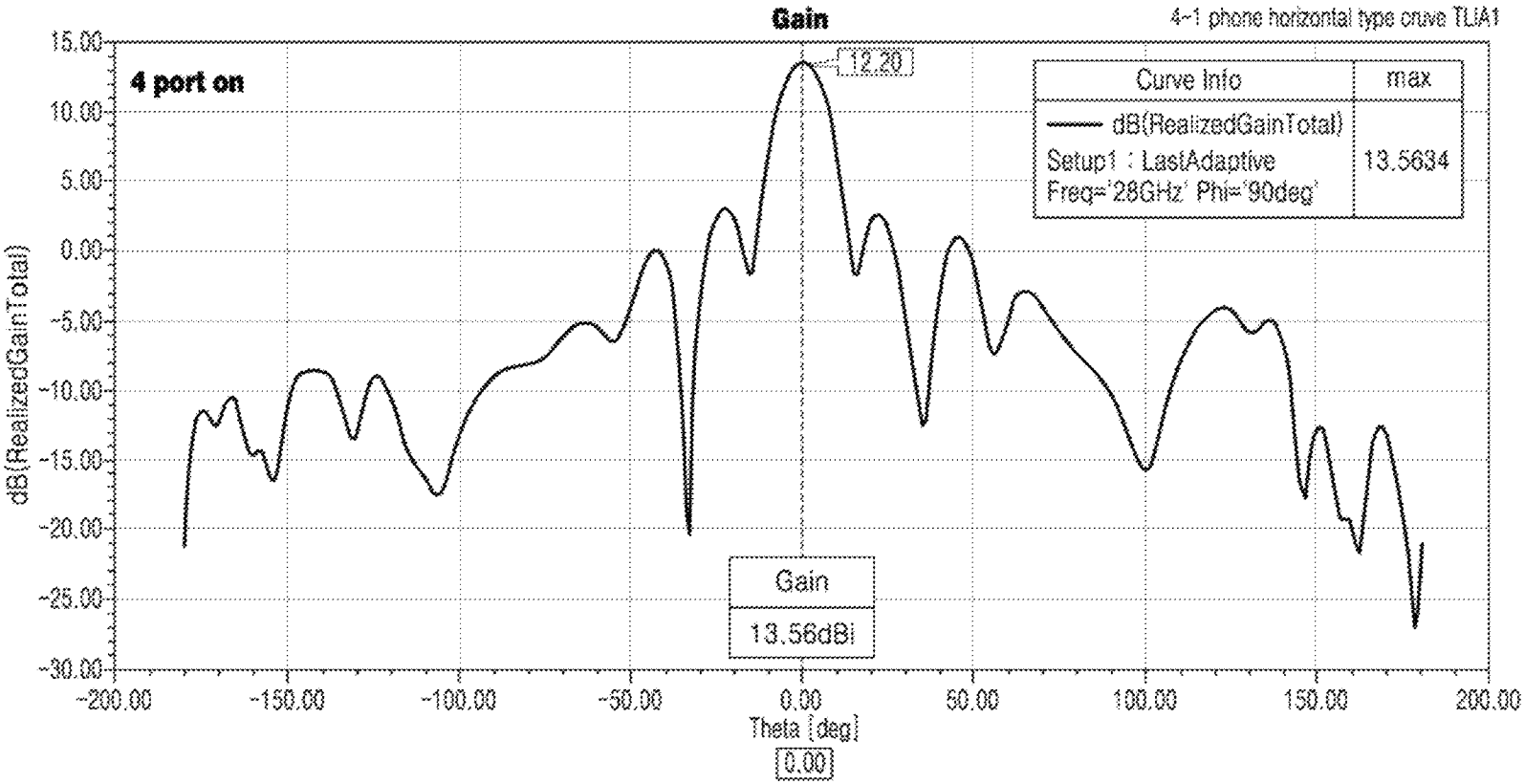
FIG. 24 illustrates a gain property of one example of the mobile communication device in which the low-loss and flexible curved transmission line-integrated multi-port antenna for an mmWave band according to the present invention is mounted.

FIG. 24 illustrates a gain property of one example of the mobile communication device in which the low-loss and flexible curved transmission line-integrated multi-port antenna for an mmWave band according to the present invention is mounted. Referring to FIG. 24, it may be seen that when the multi-port, that is, all of four ports are turned ON, a gain property is about 13.56 dBi at 0 radian which is a very high antenna gain property. In the embodiment of the present invention, although the four ports are shown as an example of the multi-port, the multi-port may include eight ports, sixteen ports, thirty-three ports, sixty-four ports, and the like, and the present invention is not limited to the number of ports.

Meanwhile, a low-loss and flexible curved transmission line-integrated multi-port antenna for an mmWave band according to another embodiment of the present invention may include a curved multi-port antenna portion and a transmission line portion.

The multi-port antenna portion includes a plurality of single antennas and forms multi-ports, for example, four ports. Each of the single antennas has a curved shape and forms one port.

The transmission line portion includes a plurality of transmission lines, and each of the transmission lines corresponds to each of the single antennas. A central conductor used as a signal line of each transmission line is integrated with an electricity feeding portion of the corresponding single antenna.

As described above with reference to FIGS. 1A to 18, each of the plurality of single antennas includes a dielectric substrate 420, 520, or 620, a signal conversion portion 430, 530, or 630, and an electricity feeding portion 440, 540, or 640.

The dielectric substrate 420, 520, or 620 is formed of a dielectric having a certain thickness on the ground plate 410 or 610. The signal conversion portion 430, 530, or 630 is formed on the dielectric substrate 420, 520, or 620 and converts an electrical signal of a mobile communication terminal into an electromagnetic wave signal and radiates the electromagnetic wave signal into the air or receives and converts an electromagnetic wave signal in the air into an electrical signal of a mobile communication terminal. The electricity feeding portion 440, 540, or 640 is formed on the dielectric substrate 420, 520, or 620 and is connected to the signal conversion portion 430, 530, or 630.

Also, each of the plurality of transmission lines includes the central conductor 710 or 810, the external conductor 720 or 820, and the dielectric 730 or 830.

One end of the central conductor 710 or 810 is integrated with the electricity feeding portion 440, 540, or 640 and transfers the transmitted or received electrical signal. The external conductor 720 or 820 has the same axis as that of the central conductor 710 or 810 and shields the central conductor 710 or 810 in an axial direction of the central conductor 710 or 810.

The dielectric 730 or 830 is formed between the central conductor 710 or 810 and the external conductor 720 or 820 in the axial direction. The dielectric 730 or 830 may be a nanostructured sheet material formed by electrospinning a resin at a high voltage as described above with reference to FIG. 9.

Figure 25:
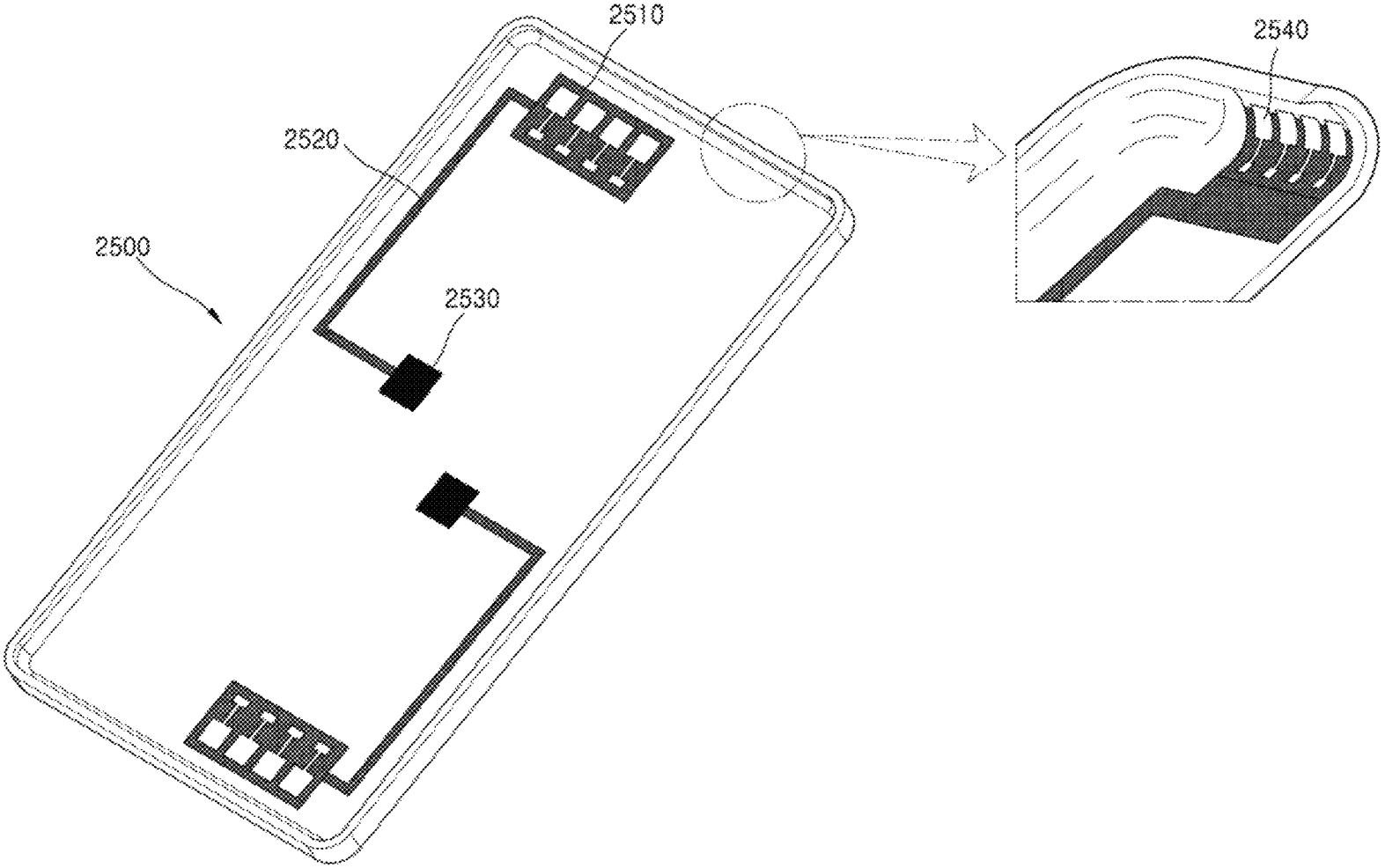
FIG. 25 illustrates on example of a mobile communication device in which a low-loss and flexible curved transmission line-integrated multi-port antenna for an mmWave band according to another embodiment of the present invention is mounted.

FIG. 25 illustrates on example of a mobile communication device in which a low-loss and flexible curved transmission line-integrated multi-port antenna for an mmWave band according to another embodiment of the present invention is mounted.

Referring to FIG. 25, in a mobile communication device 2500 in which the low-loss and flexible curved transmission line-integrated multi-port antenna according to another embodiment of the present invention is mounted, a transmission line 2520 integrated with a four-port antenna 2510 of 28 GHz may be connected to a module 2530 of the mobile communication device. It is shown that a four-port antenna 2540 of 28 GHz may be mounted curvedly one an edge of the mobile communication device 2500.

Meanwhile, the low-loss and flexible orthogonal transmission line-integrated multi-port antenna for an mmWave band according to the present invention which includes the above-described low-loss and flexible transmission line-integrated single-port antennas will be described.

Figure 26:
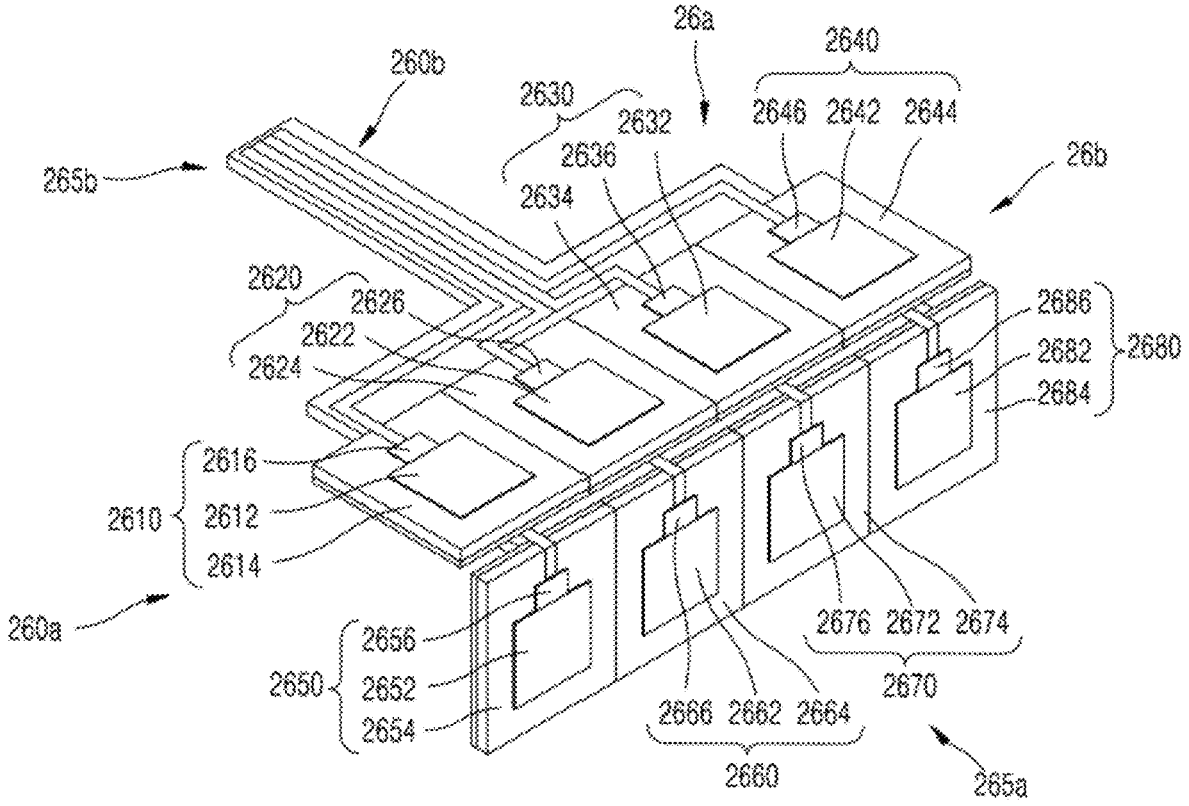
FIG. 26 illustrates one embodiment of the low-loss and flexible orthogonal transmission line-integrated multi-port antenna for an mmWave band according to the present invention.

FIG. 26 illustrates one embodiment of the low-loss and flexible orthogonal transmission line-integrated multi-port antenna for an mmWave band according to the present invention. Referring to FIG. 26, the low-loss and flexible orthogonal transmission line-integrated multi-port antenna for an mmWave band according to one embodiment of the present invention includes a first multi-port antenna 26*a* and a second multi-port antenna 26*b* perpendicular to the first multi-port antenna 26*a*.

The first multi-port antenna 26*a* includes a first multi-port antenna portion 260*a* and a first transmission line portion 260*b*. The first multi-port antenna portion 260*a* includes a plurality of single antennas 1610, 1620, 1630, and 1640, which are horizontally arranged, and forms multi-ports, for example, four ports. Each of the single antennas forms one port.

The first transmission line portion 260*b* includes a plurality of transmission lines, and each of the transmission lines corresponds to a singles antenna 2610, 2620, 2630, or 2640 and is integrated with an electricity feeding portion 2616, 2626, 2636, or 2646 to which a central conductor used as a signal line of each transmission line corresponds.

As described above with reference to FIGS. 1A to 18, each of the plurality of antennas 2610, 2620, 2630, and 2640 includes a dielectric substrate 2614, 2624, 2634, 2644, 420, 520, or 620, a signal conversion portion 2612, 2622, 2632, 2642, 430, 530, or 630, and the electricity feeding portion 2616, 2626, 2636, 2646, 440, 540, or 640.

The dielectric substrate 2614, 2624, 2634, 2644, 420, 520, or 620 is formed of a dielectric having a certain thickness on the ground plate 410 or 610. The signal conversion portion 2612, 2622, 2632, 2642, 430, 530, or 630 is formed on the dielectric substrate 2614, 2624, 2634, 2644, 420, 520, or 620 and converts an electrical signal of a mobile communication device into an electromagnetic wave signal and radiates the electromagnetic wave signal into the air or receives and converts an electromagnetic wave signal in the air into an electrical signal of a mobile communication device. The electricity feeding portion 2616, 2626, 2636, 2646, 440, 540, or 640 is formed on the dielectric substrate 2614, 2624, 2634, 2644, 420, 520, or 620) and connected to the signal conversion portion 2612, 2622, 2632, 2642, 430, 530, or 630.

Also, each of the plurality of transmission lines includes the central conductor 710 or 810, the external conductor 720 or 820, and the dielectric 730 or 830.

One end of the central conductor 710 or 810 is integrated with the electricity feeding portion 2616, 2626, 2636, 2646, 440, 540, or 640 and transfers the transmitted or received electrical signal.

The external conductor 720 or 820 has the same axis as that of the central conductor 710 or 810 and shields the central conductor 710 or 810 in an axial direction of the central conductor 710 or 810.

The dielectric 730 or 830 is formed between the central conductor 710 or 810 and the external conductor 720 or 820 in the axial direction.

The dielectric 730 or 830 may be a nanostructured sheet material formed by electrospinning a resin at a high voltage as described above with reference to FIG. 9.

Meanwhile, the second multi-port antenna 26*a* includes a second multi-port antenna portion 265*a* and a second transmission line portion 265*b*. The second multi-port antenna portion 265*a* includes a plurality of single antennas 2650, 2660 2670, and 2680, is disposed perpendicular to the first multi-port antenna portion 260*a*, and forms multi-ports, for example, four ports. Each of the single antennas forms one port.

The second transmission line portion 265*b* includes a plurality of transmission lines, and each of the transmission lines corresponds to a singles antenna 2650, 2660, 2670, or 2680 and is integrated with an electricity feeding portion 2656, 2666, 2676, or 2686 to which a central conductor used as a signal line of each transmission line corresponds.

As described above with reference to FIGS. 1A to 18, each of the plurality of antennas 2650, 2660, 2670, and 2680 includes a dielectric substrate 2654, 2664, 2674, 2684, 420, 520, or 620, a signal conversion portion 2652, 2662, 2672, 2682, 430, 530, or 630, and the electricity feeding portion 2656, 2666, 2676, 2686, 440, 540, or 640.

The dielectric substrate 2654, 2664, 2674, 2684, 420, 520, or 620 is formed of a dielectric having a certain thickness on the ground plate 410 or 610. The signal conversion portion 2652, 2662, 2672, 2682, 430, 530, or 630 is formed on the dielectric substrate 2654, 2664, 2674, 2684, 420, 520, or 620 and converts an electrical signal of a mobile communication device into an electromagnetic wave signal and radiates the electromagnetic wave signal into the air or receives and converts an electromagnetic wave signal in the air into an electrical signal of a mobile communication device. The electricity feeding portion 2656, 2666, 2676, 2686, 440, 540, or 640 is formed on the dielectric substrate 2654, 2664, 2674, 2684, 420, 520, or 620) and connected to the signal conversion portion 2652, 2662, 2672, 2682, 430, 530, or 630.

Also, each of the plurality of transmission lines includes the central conductor 710 or 810, the external conductor 720 or 820, and the dielectric 730 or 830.

One end of the central conductor 710 or 810 is integrated with the electricity feeding portion 2656, 2666, 2676, 2686, 440, 540, or 640 and transfers the transmitted or received electrical signal. The external conductor 720 or 820 has the same axis as that of the central conductor 710 or 810 and shields the central conductor 710 or 810 in an axial direction of the central conductor 710 or 810. The dielectric 730 or 830 is formed between the central conductor 710 or 810 and the external conductor 720 or 820 in the axial direction. The dielectric 730 or 830 may be a nanostructured sheet material formed by electrospinning a resin at a high voltage as described above with reference to FIG. 9.

The first multi-port antenna 26*a* of the low-loss and flexible orthogonal transmission line-integrated multi-port antenna for an mmWave band according to the present invention includes a plurality of such single antennas 2610, 2620, 2630, and 2640 horizontally arranged such that a beam pattern (radiation pattern) includes vertical polarization wave or horizontal polarization. The second multi-port antenna 26*b* thereof includes a plurality of such single antennas 2650, 2660, 2670, and 2680 vertically arranged such that a beam pattern (radiation pattern) includes vertical polarization wave or horizontal polarization. The beam pattern (radiation pattern) of the plurality of single antennas may include circular polarization.

Figure 27:
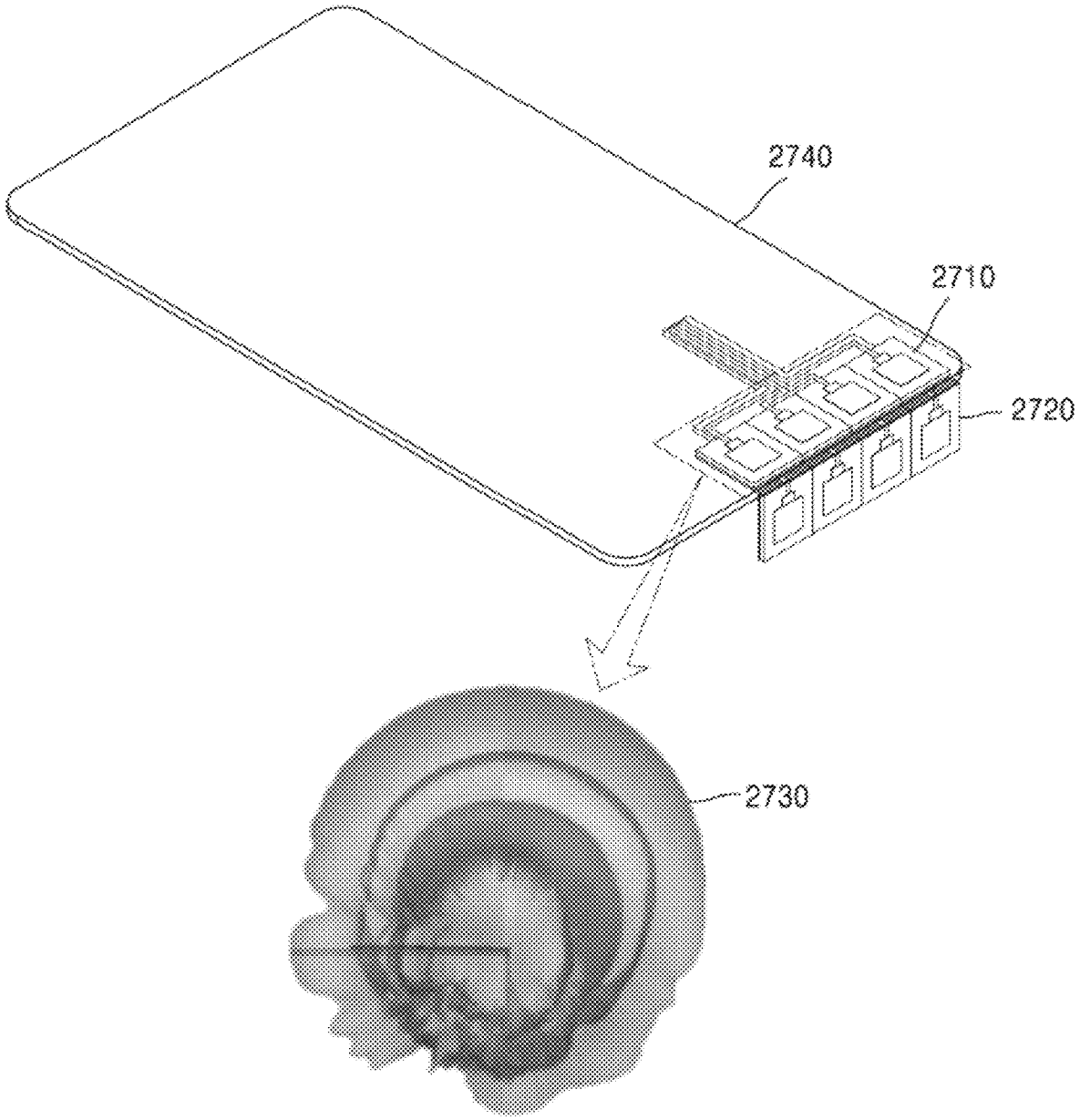
FIG. 27 illustrates a beam pattern (radiation pattern) 2730 of a transmission line-integrated patch antenna of a first multi-port antenna 2710 in the first multi-port antenna 2710 and a second multi-port antenna 2720 which are installed orthogonally in a mobile communication device 2740 as one embodiment of the low-loss and flexible orthogonal transmission line-integrated multi-port antenna for an mmWave band used in the transmission line-integrated multi-port antenna according to the present invention.

FIG. 27 illustrates a beam pattern (radiation pattern) 2730 of a transmission line-integrated patch antenna of a first multi-port antenna 2710 in the first multi-port antenna 2710 and a second multi-port antenna 2720 which are installed orthogonally in a mobile communication device 2740 as one embodiment of the low-loss and flexible orthogonal transmission line-integrated multi-port antenna for an mmWave band used in the transmission line-integrated multi-port antenna according to the present invention. The beam pattern 2730 is an electric field strength of a radiated electromagnetic wave and indicates directivity as shown in FIG. 27.

Figure 28:
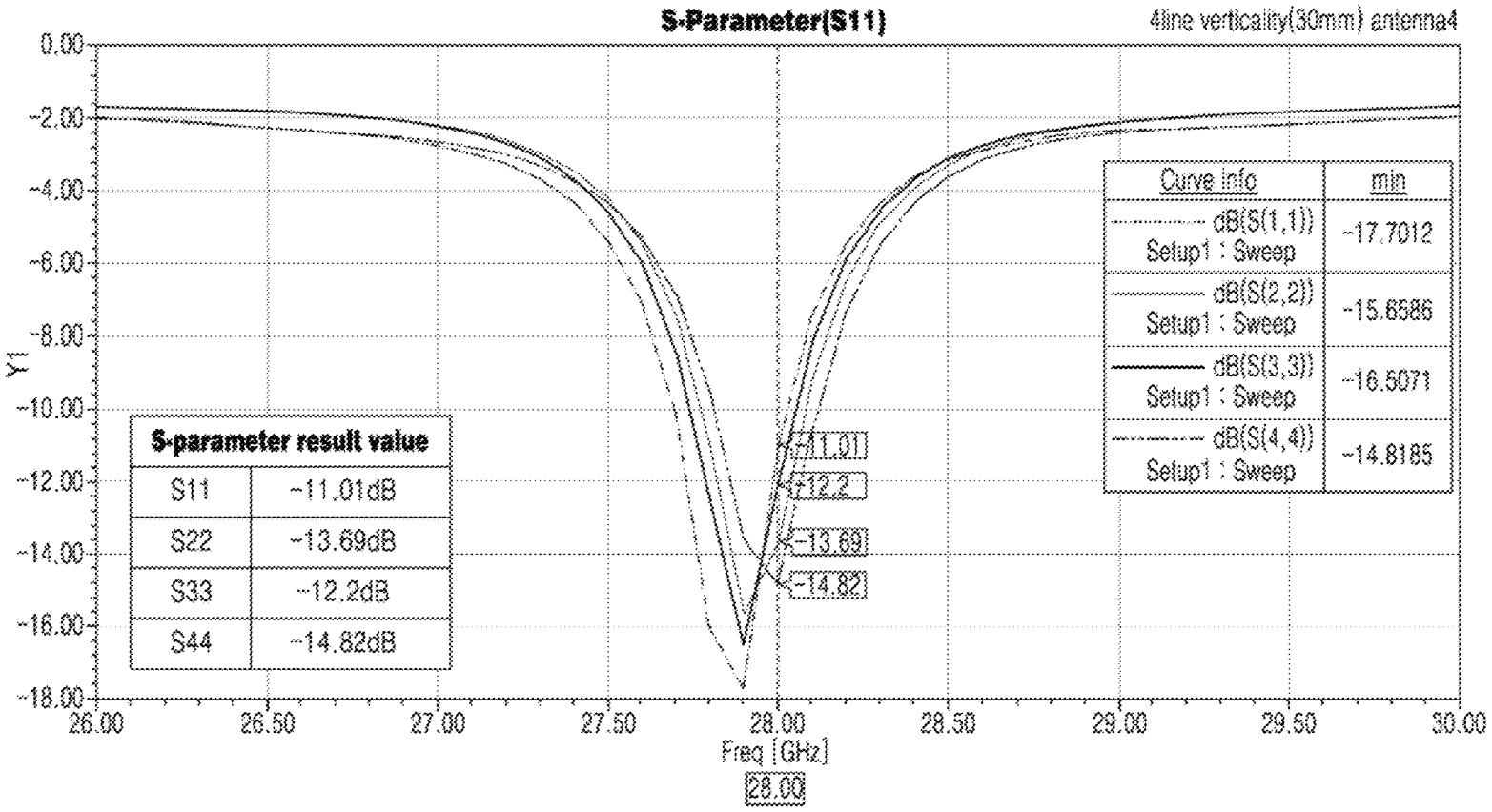
FIG. 28 illustrates properties of input reflection parameters S11, S22, S33, and S44 according to a frequency of the first multi-port antenna 2710 of the low-loss and flexible orthogonal transmission line-integrated multi-port antenna for an mmWave band according to the present invention.

FIG. 28 illustrates properties of input reflection parameters S11, S22, S33, and S44 according to a frequency of the first multi-port antenna 2710 of the low-loss and flexible orthogonal transmission line-integrated multi-port antenna for an mmWave band according to the present invention. Referring to FIG. 28, it may be seen that the first multi-port antenna 2710 of the transmission line-integrated multi-port patch antenna according to one embodiment of the present invention has excellent impedance and an excellent reflection parameter with respect to signal power input into the antenna at a frequency of 28 GHz which is a 5G communication frequency.

Figure 29:
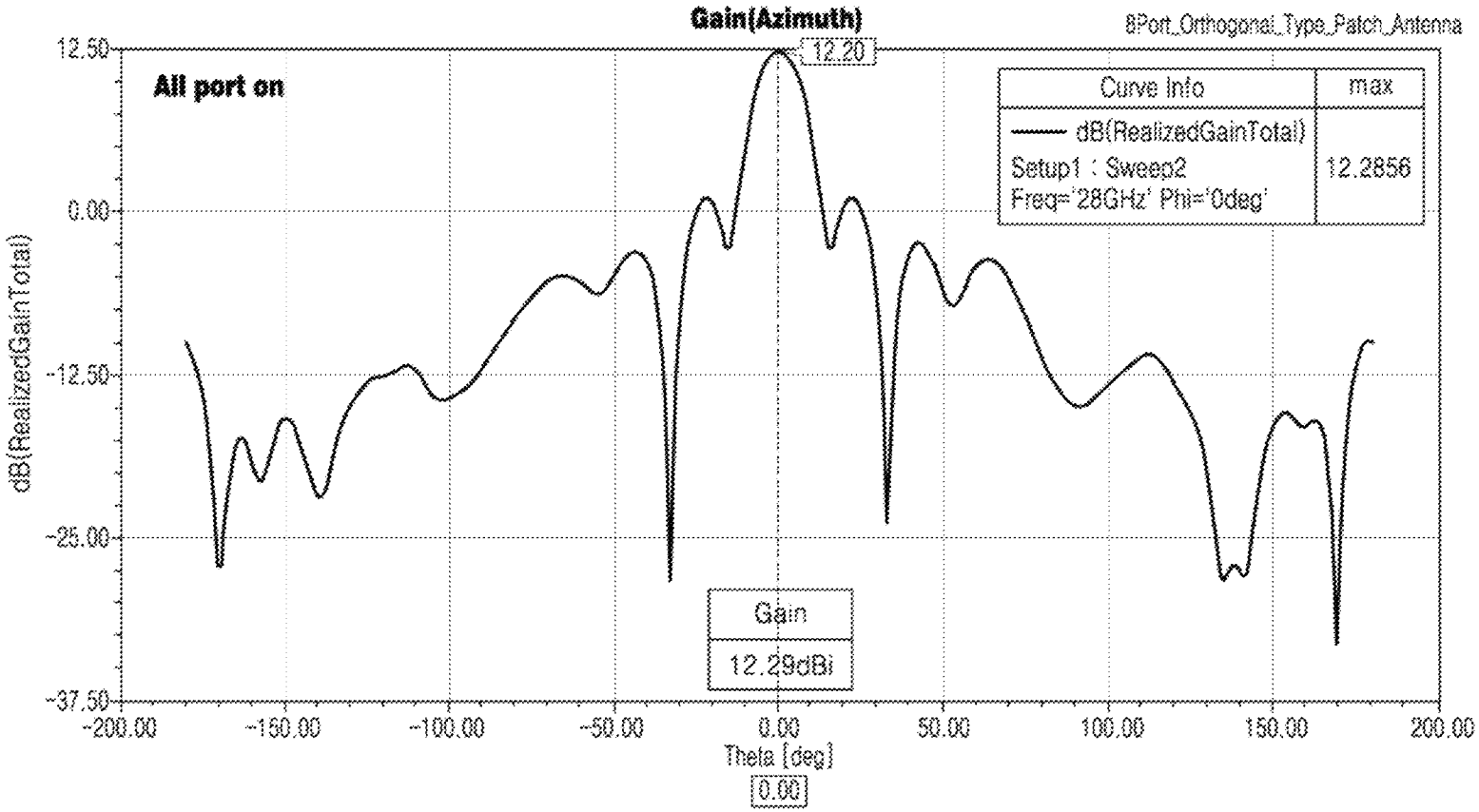
FIG. 29 illustrates a gain property of the first multi-port antenna 2710 of the low-loss and flexible orthogonal transmission line-integrated multi-port antenna for an mmWave band according to the present invention.

FIG. 29 illustrates a gain property of the first multi-port antenna 2710 of the low-loss and flexible orthogonal transmission line-integrated multi-port antenna for an mmWave band according to the present invention. Referring to FIG. 29, it may be seen that when an input signal is applied to the first multi-port antenna 2710, a gain property of vertical polarization is about 12.29 dBi at 0 radian which is a very high antenna gain property.

Figure 30:
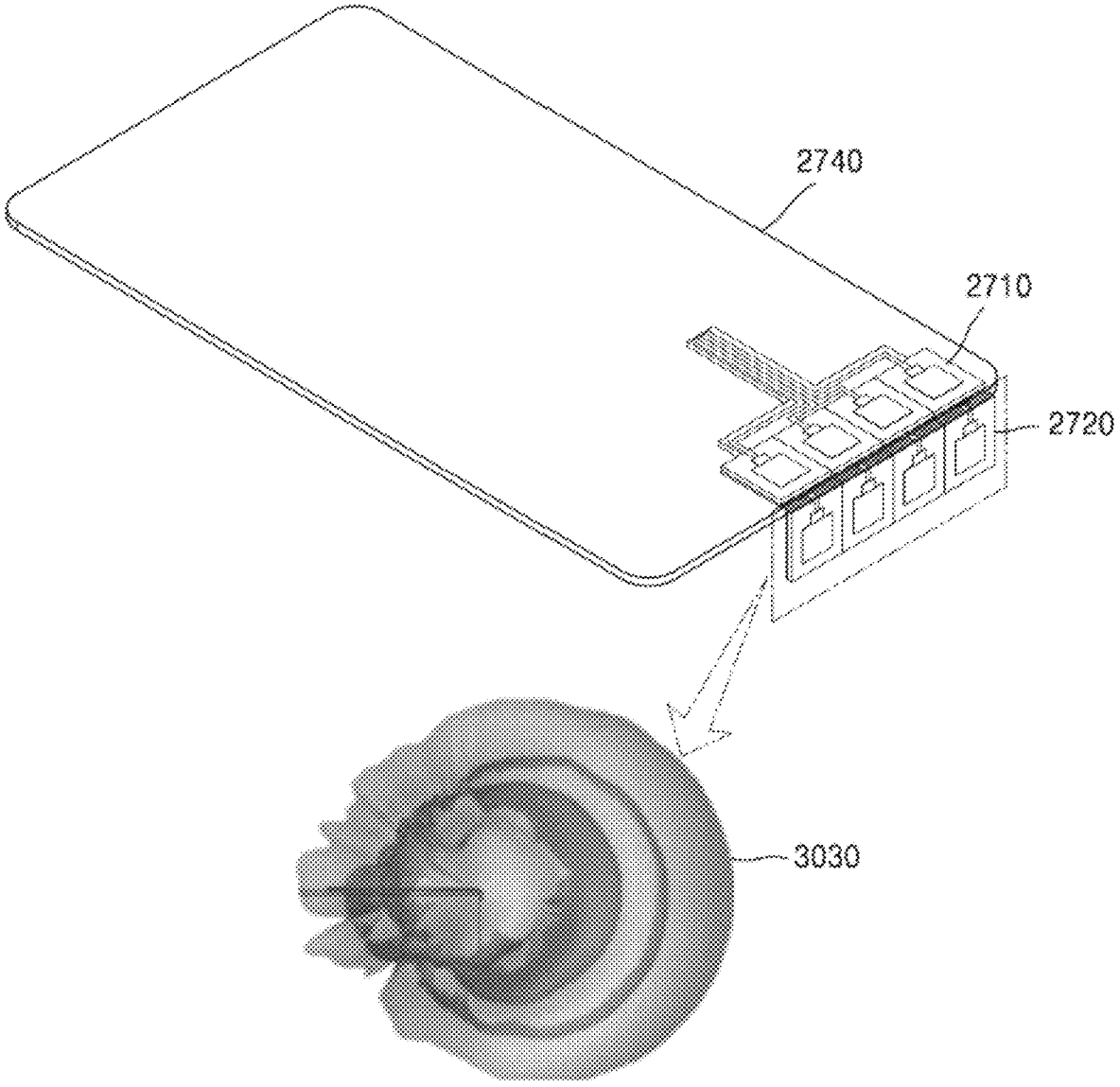
FIG. 30 illustrates a beam pattern (radiation pattern) 3030 of a transmission line-integrated patch antenna of the second multi-port antenna 2720 in the first multi-port antenna 2710 and the second multi-port antenna 2720 which are installed orthogonally in the mobile communication device 2740 as one embodiment of the low-loss and flexible orthogonal transmission line-integrated multi-port antenna for an mmWave band used in the transmission line-integrated multi-port antenna according to the present invention.

FIG. 30 illustrates a beam pattern (radiation pattern) 3030 of a transmission line-integrated patch antenna of the second multi-port antenna 2720 in the first multi-port antenna 2710 and the second multi-port antenna 2720 which are installed orthogonally in the mobile communication device 2740 as one embodiment of the low-loss and flexible orthogonal transmission line-integrated multi-port antenna for an mmWave band used in the transmission line-integrated multi-port antenna according to the present invention. The beam pattern 3030 is an electric field strength of a radiated electromagnetic wave and indicates directivity as shown in FIG. 30.

Figure 31:
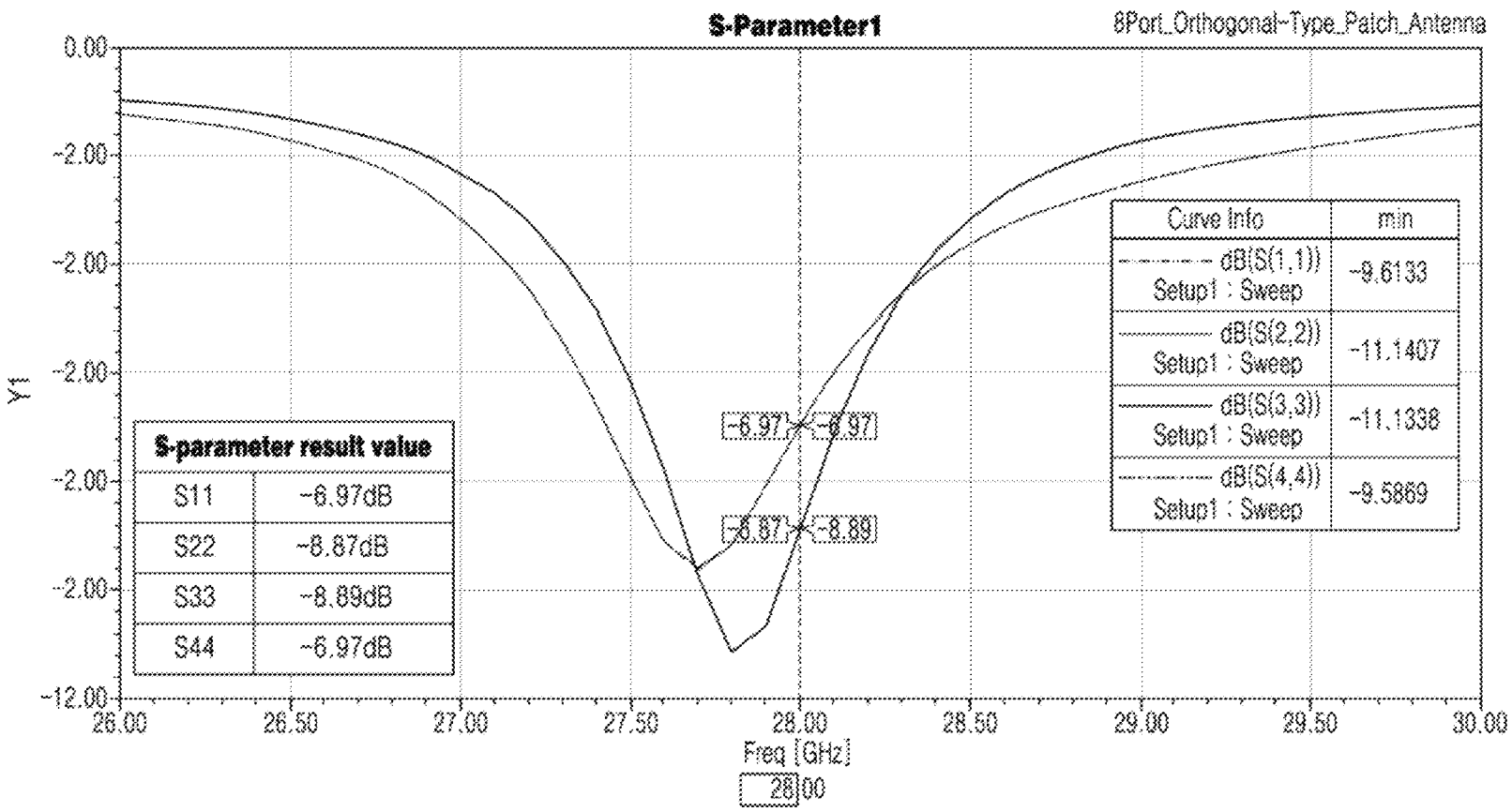
FIG. 31 illustrates properties of input reflection parameters S11, S22, S33, and S44 according to a frequency of the second multi-port antenna 2720 of the low-loss and flexible orthogonal transmission line-integrated multi-port antenna for an mmWave band according to the present invention.

FIG. 31 illustrates properties of input reflection parameters S11, S22, S33, and S44 according to a frequency of the second multi-port antenna 2720 of the low-loss and flexible orthogonal transmission line-integrated multi-port antenna for an mmWave band according to the present invention. Referring to FIG. 31, it may be seen that the second multi-port antenna 2720 of the transmission line-integrated multi-port patch antenna according to one embodiment of the present invention has excellent impedance and an excellent reflection parameter with respect to signal power input into the antenna at a frequency of 28 GHz which is a 5G communication frequency.

Figure 32:
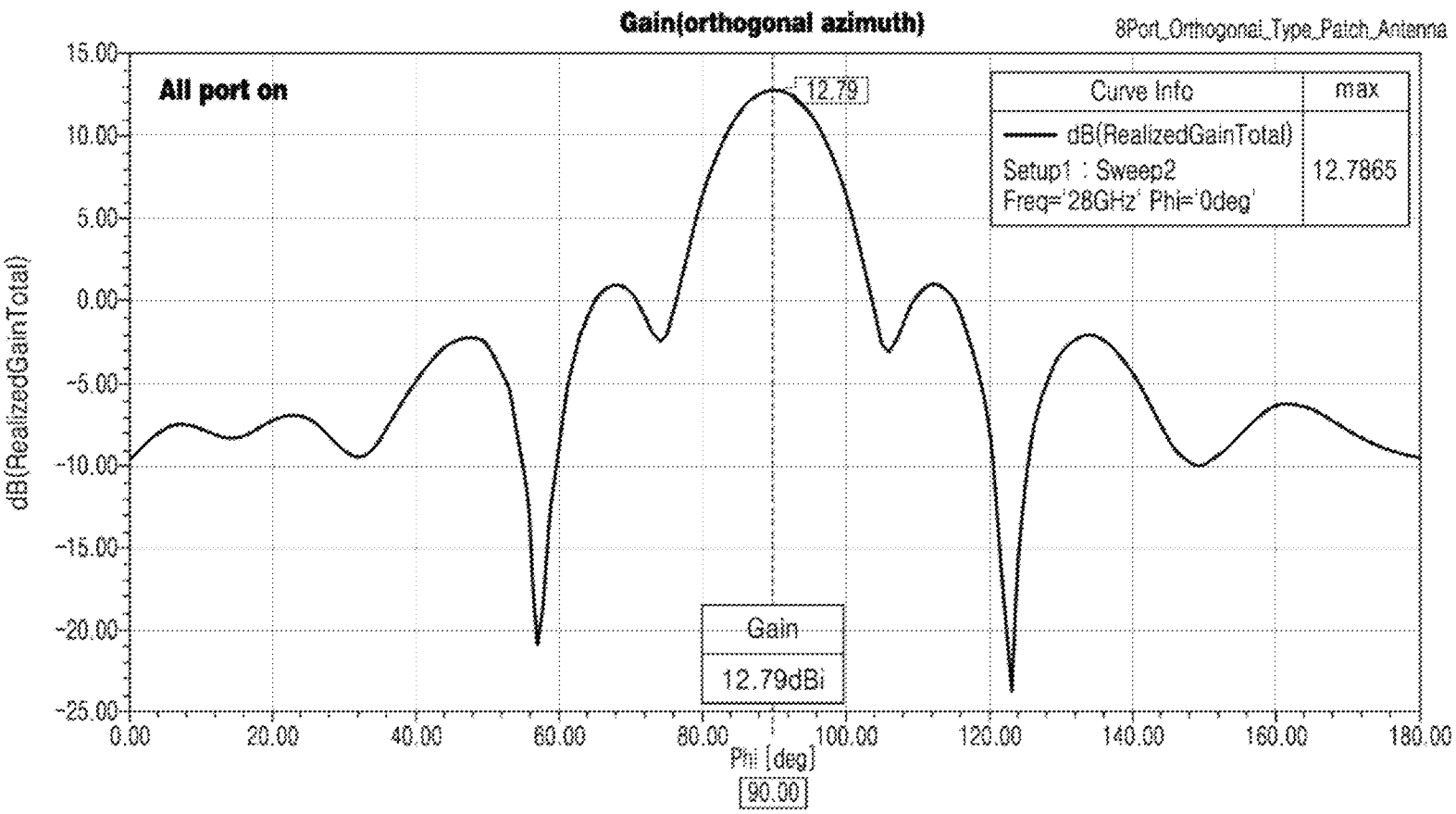
FIG. 32 illustrates a gain property of the second multi-port antenna 2720 of the low-loss and flexible orthogonal transmission line-integrated multi-port antenna for an mmWave band according to the present invention.

FIG. 32 illustrates a gain property of the second multi-port antenna 2720 of the low-loss and flexible orthogonal transmission line-integrated multi-port antenna for an mmWave band according to the present invention. Referring to FIG. 32, it may be seen that when an input signal is applied to the second multi-port antenna 2720, a gain property of vertical polarization is about 12.79 dBi at 0 radian which is a very high antenna gain property.

Figure 33:
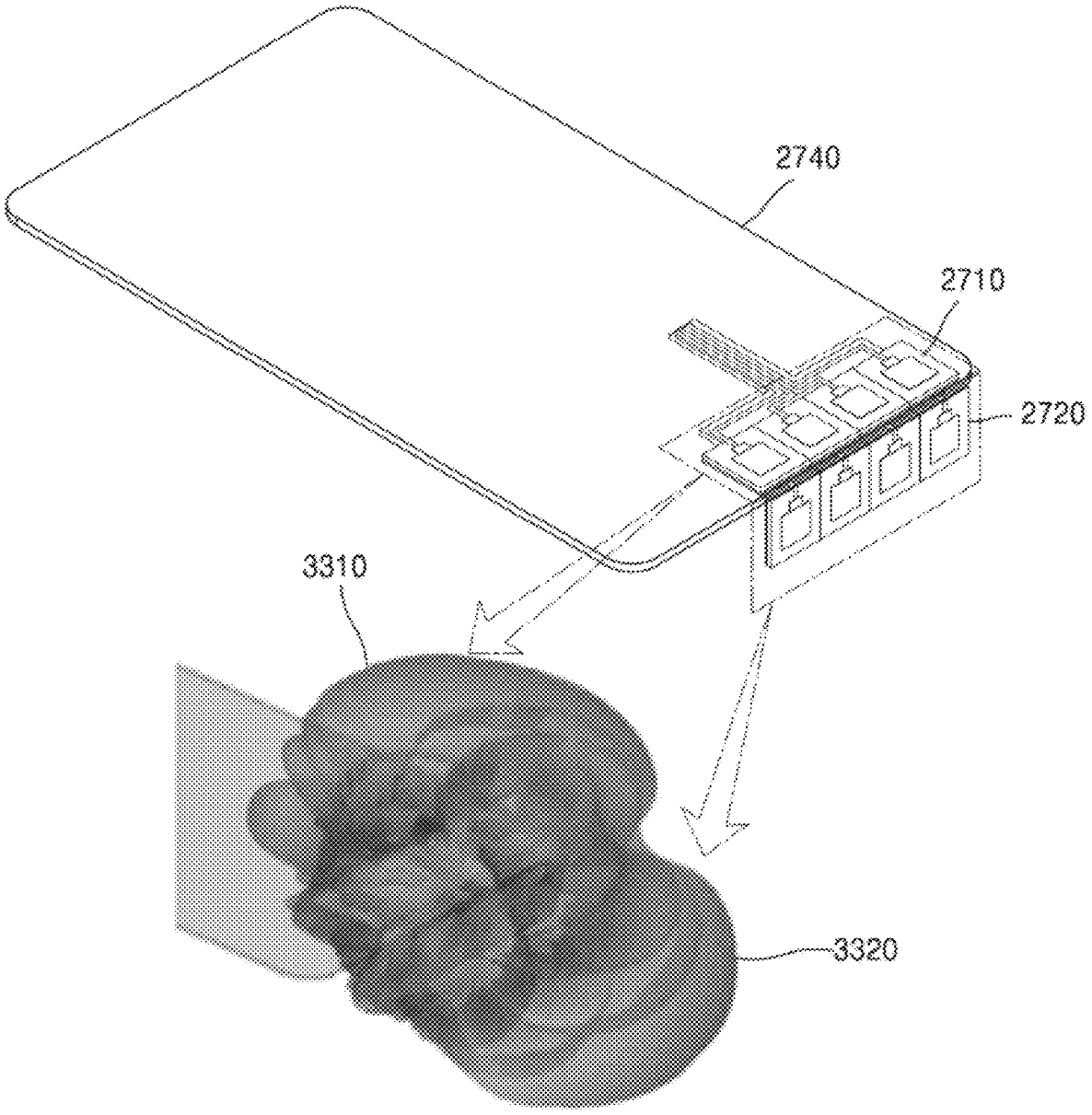
FIG. 33 illustrates beam patterns (radiation patterns) 3310 and 3320 of the transmission line-integrated patch antennas of the first multi-port antenna 2710 and the second multi-port antenna 2720 which are installed orthogonally in the mobile communication device 2740 as one embodiment of the low-loss and flexible orthogonal transmission line-integrated multi-port antenna for an mmWave band used in the transmission line-integrated multi-port antenna according to the present invention.

FIG. 33 illustrates beam patterns (radiation patterns) 3310 and 3320 of the transmission line-integrated patch antennas of the first multi-port antenna 2710 and the second multi-port antenna 2720 which are installed orthogonally in the mobile communication device 2740 as one embodiment of the low-loss and flexible orthogonal transmission line-integrated multi-port antenna for an mmWave band used in the transmission line-integrated multi-port antenna according to the present invention.

The beam patterns 3310 and 3320 are electric field strengths of radiated electromagnetic waves, and the beam pattern 3310 of the first multi-port antenna 2710 and the beam pattern 3320 of the second multi-port antenna 2720 are combined with each other and show respective directivities.

Figure 34:
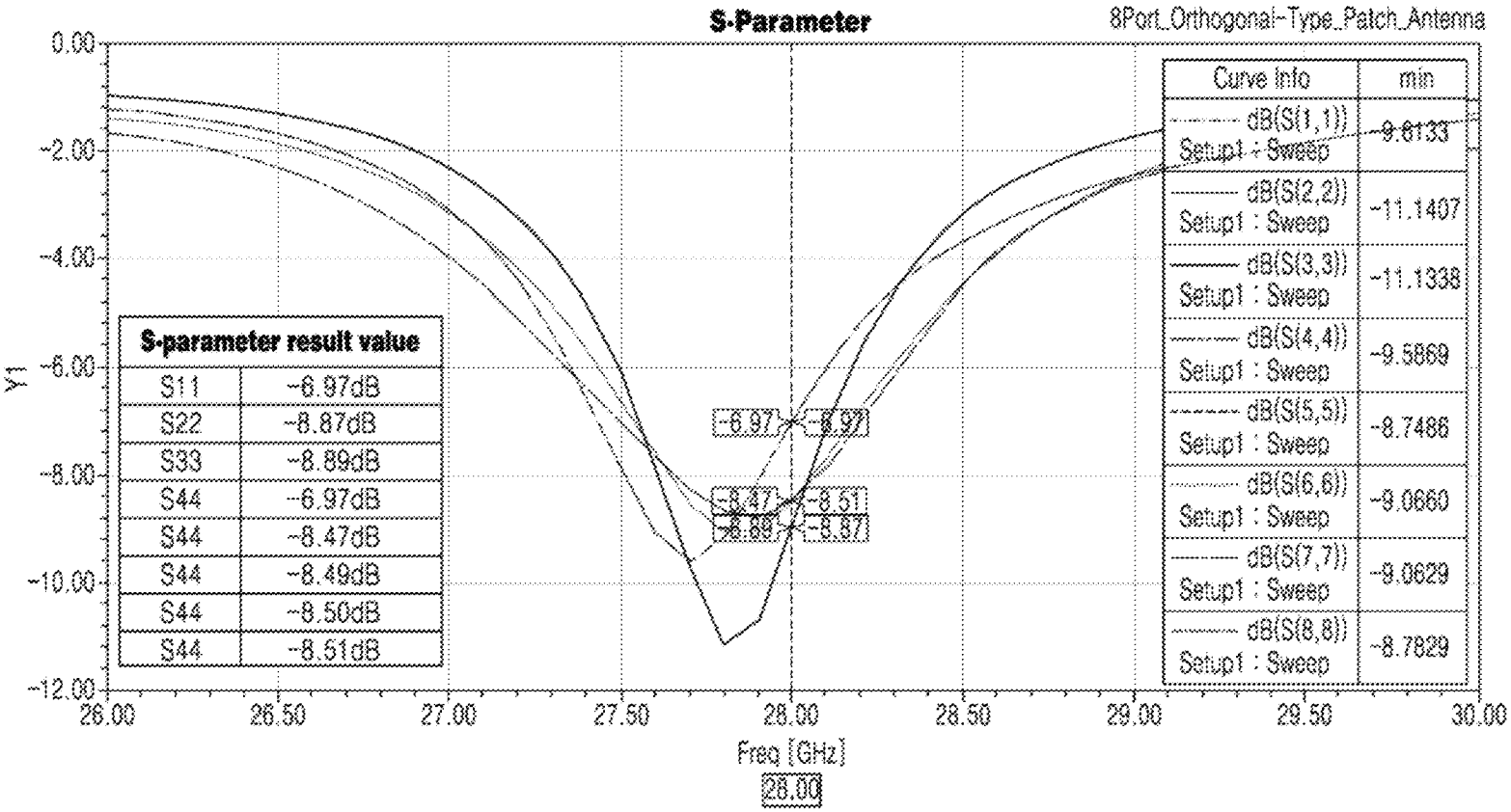
FIG. 34 illustrates properties of input reflection parameters S11, S22, S33, S44, S55, S66, S77, and S88 according to a frequency of the first multi-port antenna 2710 and the second multi-port antenna 2720 which are included in the low-loss and flexible orthogonal transmission line-integrated multi-port antenna for an mmWave band according to the present invention.

FIG. 34 illustrates properties of input reflection parameters S11, S22, S33, S44, S55, S66, S77, and S88 according to a frequency of the first multi-port antenna 2710 and the second multi-port antenna 2720 which are included in the low-loss and flexible orthogonal transmission line-integrated multi-port antenna for an mmWave band according to the present invention. Referring to FIG. 34, it may be seen that the first multi-port antenna 2710 and the second multi-port antenna 2720 included in the transmission line-integrated multi-port patch antenna according to one embodiment of the present invention have excellent impedances and excellent reflection parameters with respect to signal power input into the antenna at a frequency of 28 GHz which is a 5G communication frequency.

Figure 35:
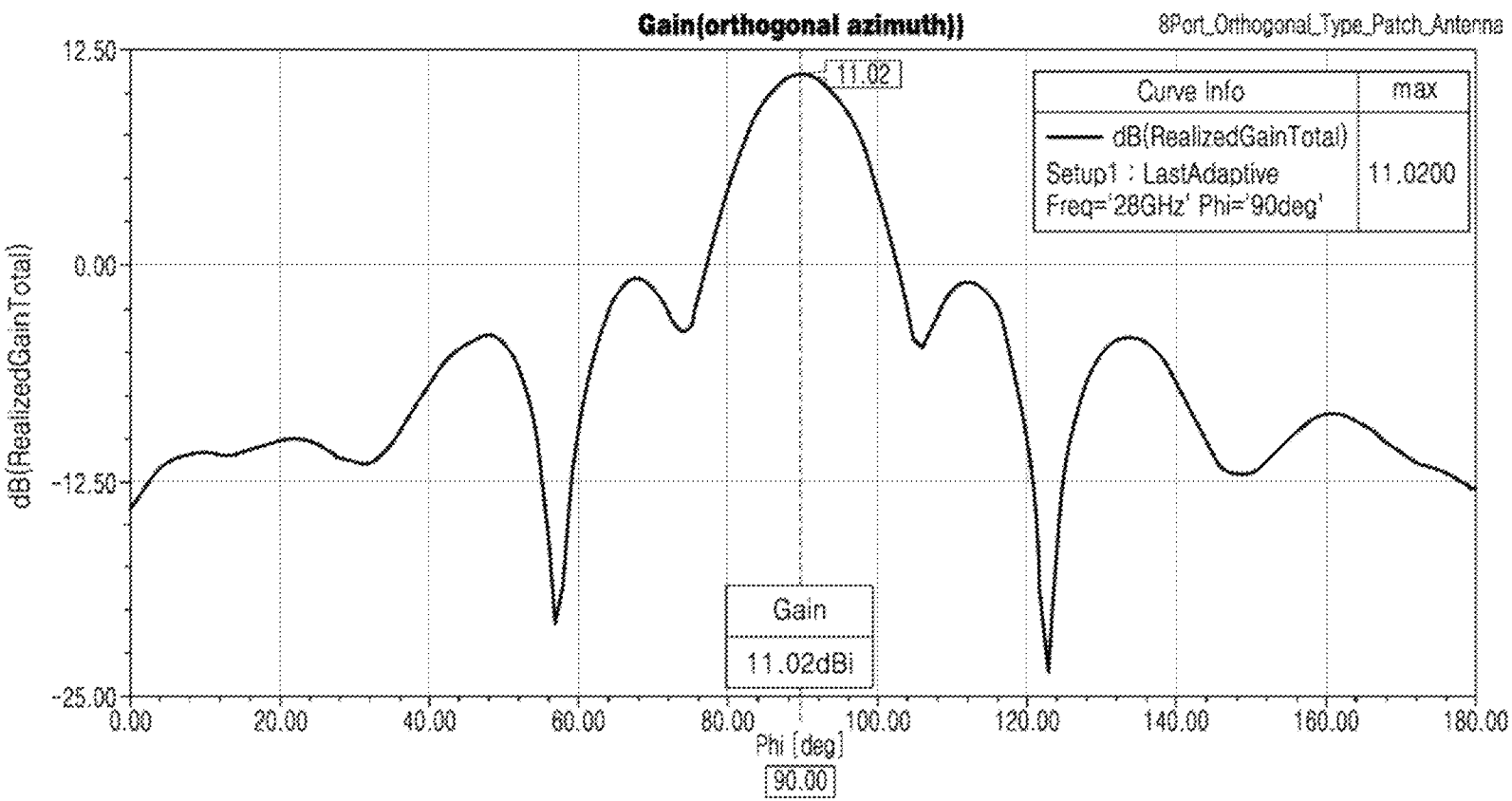
FIG. 35 illustrates a gain property of the low-loss and flexible orthogonal transmission line-integrated multi-port antenna for an mmWave band according to the present invention.

FIG. 35 illustrates a gain property of the low-loss and flexible orthogonal transmission line-integrated multi-port antenna for an mmWave band according to the present invention. Referring to FIG. 35, it may be seen that when input signals are applied to the first multi-port antenna 2710 and the second multi-port antenna 2720, a gain property of vertical polarization is about 11.02 dBi at 0 radian which is a very high antenna gain property.

Figure 36:
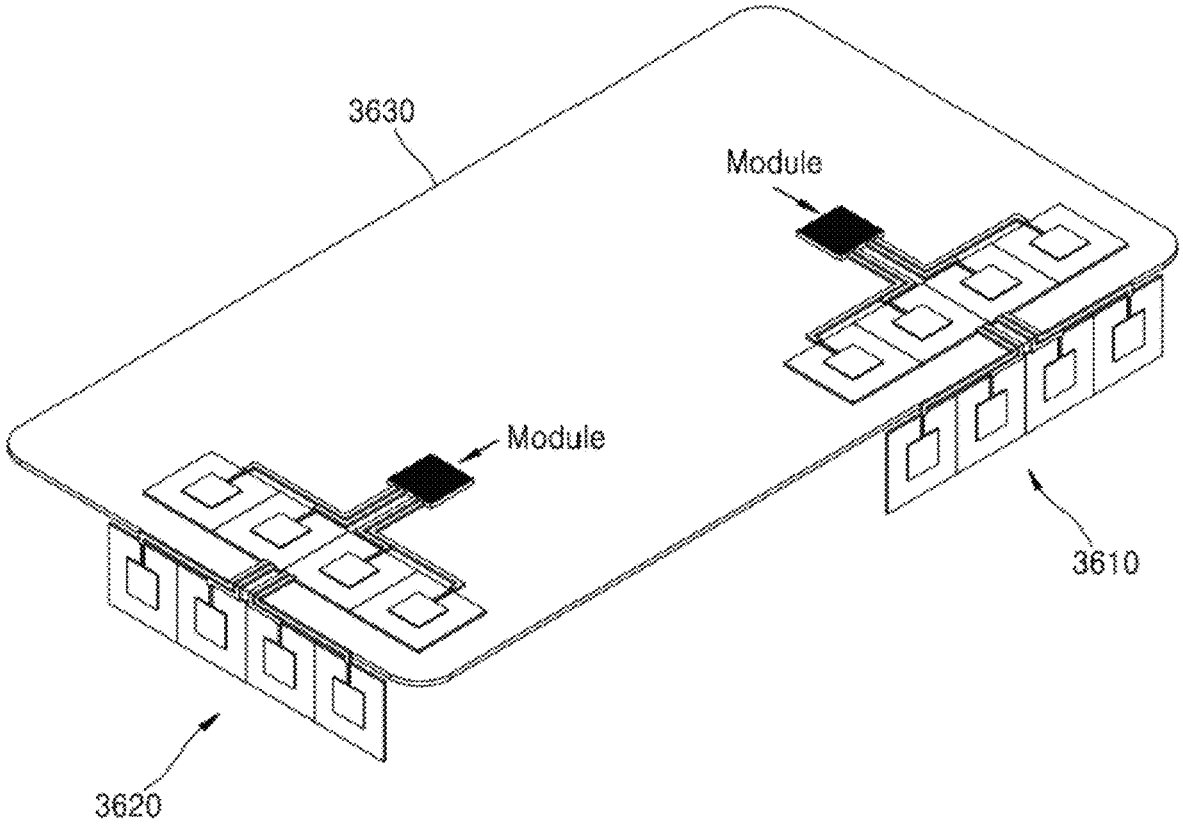
FIG. 36 illustrates a mobile communication device in which a low-loss and flexible orthogonal transmission line-integrated multi-port antenna for an mmWave band according to an embodiment of the present invention is mounted.

Meanwhile, the low-loss and flexible orthogonal transmission line-integrated multi-port antenna for an mmWave band according to the embodiment of the present invention may be used while being mounted in a 5G mobile communication device. FIG. 36 illustrates a mobile communication device in which a low-loss and flexible orthogonal transmission line-integrated multi-port antenna for an mmWave band according to an embodiment of the present invention is mounted. Referring to FIG. 36, in the low-loss and flexible orthogonal transmission line-integrated multi-port antenna according to the embodiment of the present invention, eight multi-port antennas 3610 and 3620 are installed on each of horizontal and vertical edges of a mobile communication device 3630, and totally, sixteen ports are shown. However, the present invention is not limited to the number of ports.

According to the embodiments of the present invention, a low-loss and flexible curved or orthogonal transmission line-integrated multi-port antenna for an mmWave band may be used as an antenna for a high frequency band of several ten GHzs used in a smart phone of a next-generation 5G mobile communication system.

Particularly, the low-loss and flexible curved or orthogonal transmission line-integrated multi-port antenna according to the embodiments of the present invention uses a dielectric material having low relative dielectric permittivity and a low dielectric loss tangent value for dielectrics used in a transmission line and an antenna so as to transmit or radiate superhigh frequency signals at a less loss.

Also, in the low-loss and flexible curved or orthogonal transmission line-integrated multi-port antenna according to the embodiments of the present invention, a loss which may occur due to a connection portion between the transmission line and the antenna may be eliminated by integrating the transmission line with the antenna so as to reduce a loss of a signal in a superhigh frequency band.

Also, a mobile built-in antenna may be implemented using a flexible material having flexibility so as to locate the antenna at a position of minimizing an influence of surroundings in a mobile device such as a smart phone and the like and to more efficiently arrange components in a mobile communication device.

Although the embodiments of the present invention have been described with reference to the drawings, the embodiments are merely examples and it should be understood by one of ordinary skill in the art that a variety of modifications and equivalents thereof may be made therefrom. Accordingly, the technical scope of the present invention should be determined by the technical concept of the following claims.

What is claimed is:

1. A low-loss and flexible curved transmission line-integrated multi-port antenna for an mmWave band, comprising:

a multi-port antenna portion which comprises a plurality of single antennas and forms multi-ports; and a transmission line portion which comprises a plurality of transmission lines which correspond to the single antennas, respectively, and has a curved shape, wherein central conductors used as signal lines of the transmission lines are integrated with corresponding electricity feeding portions of the single antennas, respectively, wherein the single antennas each comprise:

a ground plate;

a dielectric substrate formed of a dielectric having a certain thickness on the ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having an axis parallel to that of the central conductor and configured to shield the central conductor in an axial direction of the central conductor; and a dielectric formed between the central conductor and the external conductor in the axial direction, and wherein the dielectric used in the single antenna and the transmission line is a low-loss nanosheet material formed in a nanosheet including a plurality of air spaces by electrospinning a resin at a high voltage, wherein the transmission lines each further comprise:

a nanosheet dielectric having a certain thickness;

conductor surfaces formed on an upper surface and a lower surface of the nanosheet dielectric; and a stripline transmission line formed as a signal line in centers of the nanosheet dielectric and the conductor surfaces, and wherein a plurality of via holes are formed between the conductor surface formed above the nanosheet dielectric and the conductor surface formed below the nanosheet dielectric.

2. The low-loss and flexible curved transmission line-integrated multi-port antenna of claim 1, wherein the multi-port antenna portion comprises the plurality of single antennas, and a beam pattern (radiation pattern) of the plurality of single antennas comprises circular polarization.

3. The low-loss and flexible curved transmission line-integrated multi-port antenna of claim 1, wherein the single antennas and the transmission lines are formed by reinforcing a bonding force between the conductor and a dielectric sheet using a low-loss bonding sheet or bonding solution or by depositing the conductor on a nanosheet.

4. The low-loss and flexible curved transmission line-integrated multi-port antenna of claim 1, wherein the single antennas each have a structure of a patch antenna, a microstrip patch antenna, or a diagonal line type patch antenna in which the signal conversion portion is a patch, wherein the patch antenna or the microstrip antenna is formed of a metal and further comprises a ground plate located on a bottom surface, and wherein the dielectric substrate is formed as a dielectric having a certain thickness on the ground plate and has a transmission line-integrated type structure.

5. The low-loss and flexible curved transmission line-integrated multi-port antenna of claim 1, wherein the single antenna is a dipole antenna, a monopole antenna, or a slot antenna implemented using a variety of slots.

6. A mobile communication terminal comprising a low-loss and flexible curved transmission line-integrated multi-port antenna for an mmWave band, comprising:

a multi-port antenna portion which comprises a plurality of single antennas and forms multi-ports; and a transmission line portion which comprises a plurality of transmission lines which correspond to the single antennas, respectively, and has a curved shape, wherein central conductors used as signal lines of the transmission lines are integrated with corresponding electricity feeding portions of the single antennas, respectively, wherein the single antennas each comprise:

a ground plate;

a dielectric substrate formed of a dielectric having a certain thickness on the ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having an axis parallel to that of the central conductor and configured to shield the central conductor in an axial direction of the central conductor; and a dielectric formed between the central conductor and the external conductor in the axial direction, and wherein the dielectric used in the single antenna and the transmission line is a low-loss nanosheet material formed in a nanosheet including a plurality of air spaces by electrospinning a resin at a high voltage, wherein the transmission lines each comprise:

a nanosheet dielectric having a certain thickness;

conductor surfaces formed on an upper surface and a lower surface of the nanosheet dielectric; and a stripline transmission line formed as a signal line in centers of the nanosheet dielectric and the conductor surfaces, and wherein a plurality of via holes are formed between the conductor surface formed above the nanosheet dielectric and the conductor surface formed below the nanosheet dielectric.

7. A low-loss and flexible curved transmission line-integrated multi-port antenna for an mmWave band, comprising:

a multi-port antenna portion which comprises a plurality of single antennas each configured to form one port and has a curved shape; and a transmission line portion which comprises a plurality of transmission lines which correspond to the single antennas, respectively, wherein central conductors used as signal lines of the transmission lines are integrated with corresponding electricity feeding portions of the single antennas, respectively, wherein the single antennas each comprise:

a ground plate;

a dielectric substrate formed of a dielectric having a certain thickness on the ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having an axis parallel to that of the central conductor and configured to shield the central conductor in an axial direction of the central conductor; and a dielectric formed between the central conductor and the external conductor in the axial direction, and wherein the dielectric used in the single antenna and the transmission line is a low-loss nanosheet material formed in a nanosheet including a plurality of air spaces by electrospinning a resin at a high voltage, wherein the transmission lines each comprise:

a nanosheet dielectric having a certain thickness;

conductor surfaces formed on an upper surface and a lower surface of the nanosheet dielectric; and a stripline transmission line formed as a signal line in centers of the nanosheet dielectric and the conductor surfaces, and wherein a plurality of via holes are formed between the conductor surface formed above the nanosheet dielectric and the conductor surface formed below the nanosheet dielectric.

8. The low-loss and flexible curved transmission line-integrated multi-port antenna of claim 7, wherein the multi-port antenna portion comprises the plurality of single antennas, and a beam pattern (radiation pattern) of the plurality of single antennas comprises circular polarization.

9. The low-loss and flexible curved transmission line-integrated multi-port antenna of claim 7, wherein the single antennas and the transmission lines are formed by reinforcing a bonding force between the conductor and a dielectric sheet using a low-loss bonding sheet or bonding solution or by depositing the conductor on a nanosheet.

10. The low-loss and flexible curved transmission line-integrated multi-port antenna of claim 7, wherein the single antennas each have a structure of a patch antenna, a microstrip patch antenna, or a diagonal line type patch antenna in which the signal conversion portion is a patch, wherein the patch antenna or the microstrip antenna is formed of a metal and further comprises a ground plate located on a bottom surface, and wherein the dielectric substrate is formed as a dielectric having a certain thickness on the ground plate and has a transmission line-integrated type structure.

11. The low-loss and flexible curved transmission line-integrated multi-port antenna of claim 7, wherein the single antenna is a dipole antenna, a monopole antenna, or a slot antenna implemented using a variety of slots.

12. A mobile communication terminal comprising a low-loss and flexible curved transmission line-integrated multi-port antenna for an mmWave band, comprising:

a multi-port antenna portion which comprises a plurality of single antennas each configured to form one port and has a curved shape; and a transmission line portion which comprises a plurality of transmission lines which correspond to the single antennas, respectively, wherein central conductors used as signal lines of the transmission lines are integrated with corresponding electricity feeding portions of the single antennas, respectively, wherein the single antennas each comprise:

a ground plate;

a dielectric substrate formed of a dielectric having a certain thickness on the ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having an axis parallel to that of the central conductor and configured to shield the central conductor in an axial direction of the central conductor; and a dielectric formed between the central conductor and the external conductor in the axial direction, and wherein the dielectric used in the single antenna and the transmission line is a low-loss nanosheet material formed in a nanosheet including a plurality of air spaces by electrospinning a resin at a high voltage, wherein the transmission lines each comprise:

a nanosheet dielectric having a certain thickness;

conductor surfaces formed on an upper surface and a lower surface of the nanosheet dielectric; and a stripline transmission line formed as a signal line in centers of the nanosheet dielectric and the conductor surfaces, and wherein a plurality of via holes are formed between the conductor surface formed above the nanosheet dielectric and the conductor surface formed below the nanosheet dielectric.

13. A low-loss and flexible orthogonal transmission line-integrated multi-port antenna for an mmWave band, comprising a first multi-port antenna and a second multi-port antenna perpendicular to the first multi-port antenna, wherein the first multi-port antenna comprises:

a first multi-port antenna portion which comprises a plurality of single antennas horizontally arranged to form multi-ports; and a first transmission line portion which comprises a plurality of transmission lines which correspond to the single antennas, respectively, wherein central conductors used as signal lines of the transmission lines are integrated with corresponding electricity feeding portions of the single antennas, respectively, wherein the second multi-port antenna comprises:

a second multi-port antenna portion which comprises a plurality of single antennas arranged perpendicularly to the first multi-port antenna portion to form multi-ports; and a second transmission line portion which comprises a plurality of transmission lines which correspond to the single antennas of the second multi-port antenna portion, respectively, wherein central conductors used as signal lines of the transmission lines are integrated with corresponding electricity feeding portions of the single antennas of the second multi-port antenna portion, respectively, wherein the single antennas of the first multi-port antenna portion and the second multi-port antenna portion each comprise:

a ground plate;

a dielectric substrate formed of a dielectric having a certain thickness on the ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having an axis parallel to that of the central conductor and configured to shield the central conductor in an axial direction of the central conductor; and a dielectric formed between the central conductor and the external conductor in the axial direction, and wherein the dielectric used in the single antenna and the transmission line is a low-loss nanosheet material formed in a nanosheet including a plurality of air spaces by electrospinning a resin at a high voltage, wherein the transmission lines each comprise:

a nanosheet dielectric having a certain thickness;

conductor surfaces formed on an upper surface and a lower surface of the nanosheet dielectric; and a stripline transmission line formed as a signal line in centers of the nanosheet dielectric and the conductor surfaces, and wherein a plurality of via holes are formed between the conductor surface formed above the nanosheet dielectric and the conductor surface formed below the nanosheet dielectric.

14. The low-loss and flexible orthogonal transmission line-integrated multi-port antenna of claim 13, wherein the first multi-port antenna comprises the plurality of single antennas horizontally arranged such that a beam pattern (radiation pattern) comprises vertical polarization or horizontal polarization, and wherein the second multi-port antenna comprises the plurality of single antennas vertically arranged such that a beam pattern (radiation pattern) comprises vertical polarization or horizontal polarization.

15. The low-loss and flexible orthogonal transmission line-integrated multi-port antenna of claim 13, wherein the single antennas and the transmission lines are formed by reinforcing a bonding force between the conductor and a dielectric sheet using a low-loss bonding sheet or bonding solution or by depositing the conductor on a nanosheet.

16. The low-loss and flexible orthogonal transmission line-integrated multi-port antenna of claim 13, wherein the single antennas each have a structure of a patch antenna, a microstrip patch antenna, or a diagonal line type patch antenna in which the signal conversion portion is a patch, wherein the patch antenna or the microstrip antenna is formed of a metal and further comprises a ground plate located on a bottom surface, and wherein the dielectric substrate is formed as a dielectric having a certain thickness on the ground plate and has a transmission line-integrated type structure.

17. The low-loss and flexible orthogonal transmission line-integrated multi-port antenna of claim 13, wherein the single antenna is a dipole antenna, a monopole antenna, or a slot antenna implemented using a variety of slots.

18. A mobile communication terminal comprising a low-loss and flexible orthogonal transmission line-integrated multi-port antenna for an mmWave band, comprising a first multi-port antenna and a second multi-port antenna perpendicular to the first multi-port antenna, wherein the first multi-port antenna comprises:

a first multi-port antenna portion which comprises a plurality of single antennas horizontally arranged to form multi-ports; and a first transmission line portion which comprises a plurality of transmission lines which correspond to the single antennas, respectively, wherein central conductors used as signal lines of the transmission lines are integrated with corresponding electricity feeding portions of the single antennas, respectively, wherein the second multi-port antenna comprises:

a second multi-port antenna portion which comprises a plurality of single antennas arranged perpendicularly to the first multi-port antenna portion to form multi-ports; and a second transmission line portion which comprises a plurality of transmission lines which correspond to the single antennas of the second multi-port antenna portion, respectively, wherein central conductors used as signal lines of the transmission lines are integrated with corresponding electricity feeding portions of the single antennas of the second multi-port antenna portion, respectively, wherein the single antennas of the first multi-port antenna portion and the second multi-port antenna portion each comprise:

a ground plate;

a dielectric substrate formed of a dielectric having a certain thickness on the ground plate;

a signal conversion portion formed on the dielectric substrate and configured to convert an electrical signal of a mobile communication terminal into an electromagnetic wave signal and radiate the electromagnetic wave signal into the air or to receive an electromagnetic wave signal in the air into an electrical signal of a mobile communication terminal; and an electricity feeding portion formed on the dielectric substrate and connected to the signal conversion portion, wherein the transmission lines each comprise:

a central conductor having one end integrated with the electricity feeding portion of the antenna and configured to transfer the transmitted or received electrical signal;

an external conductor having an axis parallel to that of the central conductor and configured to shield the central conductor in an axial direction of the central conductor; and a dielectric formed between the central conductor and the external conductor in the axial direction, and wherein the dielectric used in the single antenna and the transmission line is a low-loss nanosheet material formed in a nanosheet including a plurality of air spaces by electrospinning a resin at a high voltage, wherein the transmission lines each comprise:

a nanosheet dielectric having a certain thickness;

conductor surfaces formed on an upper surface and a lower surface of the nanosheet dielectric; and a stripline transmission line formed as a signal line in centers of the nanosheet dielectric and the conductor surfaces, and wherein a plurality of via holes are formed between the conductor surface formed above the nanosheet dielectric and the conductor surface formed below the nanosheet dielectric.

* * * * *